US009552762B2

(12) United States Patent
Inoue et al.

(10) Patent No.: US 9,552,762 B2
(45) Date of Patent: Jan. 24, 2017

(54) SELF-LUMINOUS DISPLAY DEVICE, CONTROL METHOD OF SELF-LUMINOUS DISPLAY DEVICE, AND COMPUTER PROGRAM

(71) Applicant: Sony Corporation, Tokyo (JP)

(72) Inventors: Yasuo Inoue, Tokyo (JP); Yohei Funatsu, Kanagawa (JP); Takashi Uchida, Kanagawa (JP)

(73) Assignee: Sony Corporation, Tokyo (JP)

( * ) Notice: Subject to any disclaimer, the term of this patent is extended or adjusted under 35 U.S.C. 154(b) by 92 days.

(21) Appl. No.: 14/135,025

(22) Filed: Dec. 19, 2013

(65) Prior Publication Data

US 2014/0176403 A1 Jun. 26, 2014

(30) Foreign Application Priority Data

Dec. 26, 2012 (JP) ..... 2012-283322

(51) Int. Cl.
*G09G 3/3208* (2016.01)
*G09G 3/20* (2006.01)
*G09G 3/32* (2016.01)

(52) U.S. Cl.
CPC ..... *G09G 3/3208* (2013.01); *G09G 3/2007* (2013.01); *G09G 3/2092* (2013.01); *G09G 2320/04* (2013.01); *G09G 2320/041* (2013.01); *G09G 2320/048* (2013.01)

(58) Field of Classification Search
CPC .. G09G 3/3208; G09G 3/2092; G09G 3/2007; G09G 3/30; G09G 3/32; G09G 2320/04–2320/048
See application file for complete search history.

(56) References Cited

U.S. PATENT DOCUMENTS

| | | | | |
|---|---|---|---|---|
| 2003/0063053 | A1* | 4/2003 | Yamazaki et al. | 345/82 |
| 2006/0164348 | A1* | 7/2006 | Ozawa et al. | 345/76 |
| 2006/0279490 | A1* | 12/2006 | Park et al. | 345/76 |
| 2007/0236431 | A1* | 10/2007 | Tada et al. | 345/84 |
| 2008/0055210 | A1* | 3/2008 | Cok | 345/77 |
| 2008/0122761 | A1* | 5/2008 | Cok et al. | 345/82 |

(Continued)

FOREIGN PATENT DOCUMENTS

WO 2008-143130 A1 11/2008

*Primary Examiner* — Dwayne Bost
*Assistant Examiner* — Ivelisse Martinez Quiles
(74) *Attorney, Agent, or Firm* — Chip Law Group

(57) ABSTRACT

There is provided a self-luminous display device including a deterioration amount acquisition section configured to acquire a cumulative deterioration amount for each of a plurality of pixels arranged in a matrix shape on a screen, each of the pixels including a light emitting element which emits light by itself in accordance with a current amount, a deterioration amount calculation section configured to calculate a deterioration amount when an image is displayed based on a supplied video signal in each of the pixels by using a deterioration characteristic determined in accordance with a luminance of the video signal, and a cumulative information update section configured to reflect the cumulative deterioration amount acquired by the deterioration amount acquisition section in the deterioration amount calculated by the deterioration amount calculation section, and to update the reflected cumulative deterioration amount as a new cumulative deterioration amount.

12 Claims, 27 Drawing Sheets

(56) References Cited

U.S. PATENT DOCUMENTS

| | | | | |
|---|---|---|---|---|
| 2008/0284767 | A1* | 11/2008 | Mori et al. | 345/207 |
| 2009/0015604 | A1* | 1/2009 | Ozaki | G09G 3/3225 345/694 |
| 2009/0147032 | A1* | 6/2009 | Kim | 345/690 |
| 2010/0165009 | A1* | 7/2010 | Mori et al. | 345/690 |
| 2011/0216084 | A1* | 9/2011 | Mori et al. | 345/589 |
| 2012/0068986 | A1* | 3/2012 | Mizutani | G09G 3/3225 345/211 |

* cited by examiner

FIG.13

| GRADATION / EFFICIENCY | GRADATION 0 | GRADATION 32 | GRADATION 64 | ... |
|---|---|---|---|---|
| 1 | ... | INCLINATION (1) | INCLINATION (4) | ... |
| 0.96875 | ... | INCLINATION (2) | INCLINATION (5) | ... |
| 0.9375 | ... | INCLINATION (3) | INCLINATION (6) | ... |
| ... | ... | ... | ... | ... |

FIG.15

| GRADATION / SHIFT AMOUNT | GRADATION 0 | GRADATION 32 | GRADATION 64 | ... |
|---|---|---|---|---|
| 0 | ... | INCLINATION (1) | INCLINATION (4) | ... |
| 2 | ... | INCLINATION (2) | INCLINATION (5) | ... |
| 4 | ... | INCLINATION (3) | INCLINATION (6) | ... |
| ... | ... | ... | ... | ... |

SELF-LUMINOUS DISPLAY DEVICE, CONTROL METHOD OF SELF-LUMINOUS DISPLAY DEVICE, AND COMPUTER PROGRAM

CROSS REFERENCE TO RELATED APPLICATIONS

This application claims the benefit of Japanese Priority Patent Application JP 2012-283322 filed Dec. 26, 2012, the entire contents of which are incorporated herein by reference.

BACKGROUND

The present disclosure relates to a self-luminous display device, a control method of a self-luminous display device, and a computer program.

Liquid crystal display devices using liquid crystals and plasma display devices using plasma have been implemented as thin display devices with a flat plane.

A liquid crystal display device is a display device including a backlight which displays images by changing an arrangement of liquid crystal molecules by the application of a voltage, and by allowing light to pass from the backlight and shielding the light. Further, a plasma display device is a display device which displays images by having a plasma state by applying a voltage to a gas enclosed within a substrate, and by making ultraviolet light, which is generated by energy occurring at the time when returning to an original state from the plasma state, visible light by irradiating on a fluorescent body.

On the other hand, development has been progressing in recent years for self-luminous type display devices using organic EL (electro luminescence) elements which emit light by the elements themselves when a voltage is applied. An organic EL element changes from a ground state to an excited state when energy is received by electrodes, and discharges the energy of a difference when returning from the excited state to the ground state. An organic EL display device is a display device which displays images by using the light discharged by these organic EL elements.

A self-luminous type display device is different to a liquid crystal display device in which a backlight is necessary, and since is it not necessary to have a backlight in order for elements to emit light by themselves, a self-luminous type display device is capable of having a thin configuration when compared to that of a liquid crystal display device. Further, since moving image characteristics, viewing angle characteristics, color reproductively and the like are superior when compared to those of a liquid crystal display device, self-luminous type display devices using organic EL elements have been receiving attention as next generation thin display devices with a flat plane.

Since a self-luminous type display device emits light by the elements themselves, deterioration of the light emitting elements occurs when continuing to emit light. Also, the light emitting elements have deterioration characteristics which are different for each of red, green and blue, which are the three primary colors. Therefore, an emission balance of the three colors of red, green and blue will collapse due to the deterioration of the emitting elements, and as a result, a color temperature of the image will be displayed on the screen different from that which is desired. Such a phenomenon is generally called an image persistence phenomenon. Accordingly, technology is disclosed in JP 2008-143130A which calculates a light emission time from a video signal, acquires a luminance of the light emitting elements from the calculated light emission time, and performs a correction of image persistence based on information of the acquired luminance.

SUMMARY

While the technology disclosed in JP 2008-143130A calculates a light emission time from a video signal, acquires a luminance of the light emitting elements from the calculated light emission time, and corrects image persistence such as described above, the technology disclosed in JP 2008-143130A performs a correction of image persistence by using the deterioration characteristics at some specific luminance. However, since a self-luminous type display device using organic EL elements has different deterioration characteristics in accordance with the luminance, a self-luminous type display device is sought after which obtains a more accurate deterioration amount, and which corrects image persistence in accordance with this deterioration amount.

Accordingly, the present disclosure provides a new and improved self-luminous display device, a control method of a self-luminous display device, and a computer program capable of obtaining a more accurate deterioration amount, and correcting luminance in accordance with the obtained deterioration amount.

According to an embodiment of the present disclosure, there is provided a self-luminous display device including a deterioration amount acquisition section configured to acquire a cumulative deterioration amount for each of a plurality of pixels arranged in a matrix shape on a screen, each of the pixels including a light emitting element which emits light by itself in accordance with a current amount, a deterioration amount calculation section configured to calculate a deterioration amount when an image is displayed based on a supplied video signal in each of the pixels by using a deterioration characteristic determined in accordance with a luminance of the video signal, and a cumulative information update section configured to reflect the cumulative deterioration amount acquired by the deterioration amount acquisition section in the deterioration amount calculated by the deterioration amount calculation section, and to update the reflected cumulative deterioration amount as a new cumulative deterioration amount.

According to an embodiment of the present disclosure, there is provided a control method of a self-luminous display device, the control method including acquiring a cumulative deterioration amount for each of a plurality of pixels arranged in a matrix shape on a screen, each of the pixels including a light emitting element which emits light by itself in accordance with a current amount, calculating a deterioration amount when an image is displayed based on a supplied video signal by using a deterioration characteristic determined in accordance with a luminance of the video signal, and reflecting the deterioration amount calculated in the deterioration amount calculation step in the cumulative deterioration amount acquired in the deterioration amount acquisition step, and updating the reflected cumulative deterioration amount as a new cumulative deterioration amount.

According to an embodiment of the present disclosure, there is provided a computer program for causing a computer to execute acquiring a cumulative deterioration amount for each of a plurality of pixels arranged in a matrix shape on a screen, each of the pixels including a light emitting element which emits light by itself in accordance with a current amount, calculating a deterioration amount when an image is displayed based on a supplied video signal by using a deterioration characteristic determined in accordance with a luminance of the video signal, and reflecting the deterioration amount calculated in the deterioration amount calculation step in the cumulative deterioration amount acquired in the deterioration amount acquisition step, and updating the reflected cumulative deterioration amount as a new cumulative deterioration amount.

According to an embodiment of the present disclosure such as described above, a new and improved self-luminous display device, a control method of a self-luminous display device, and a computer program can be provided capable of obtaining a more accurate deterioration amount, and correcting luminance in accordance with the obtained deterioration amount.

BRIEF DESCRIPTION OF THE DRAWINGS

FIG. 13 is an explanatory diagram which shows a look-up table of deterioration characteristics for a plurality of gradations;

FIG. 15 is an explanatory diagram which shows a look-up table of deterioration characteristics for a plurality of gradations;

DETAILED DESCRIPTION OF THE EMBODIMENT(S)

Figure 1:
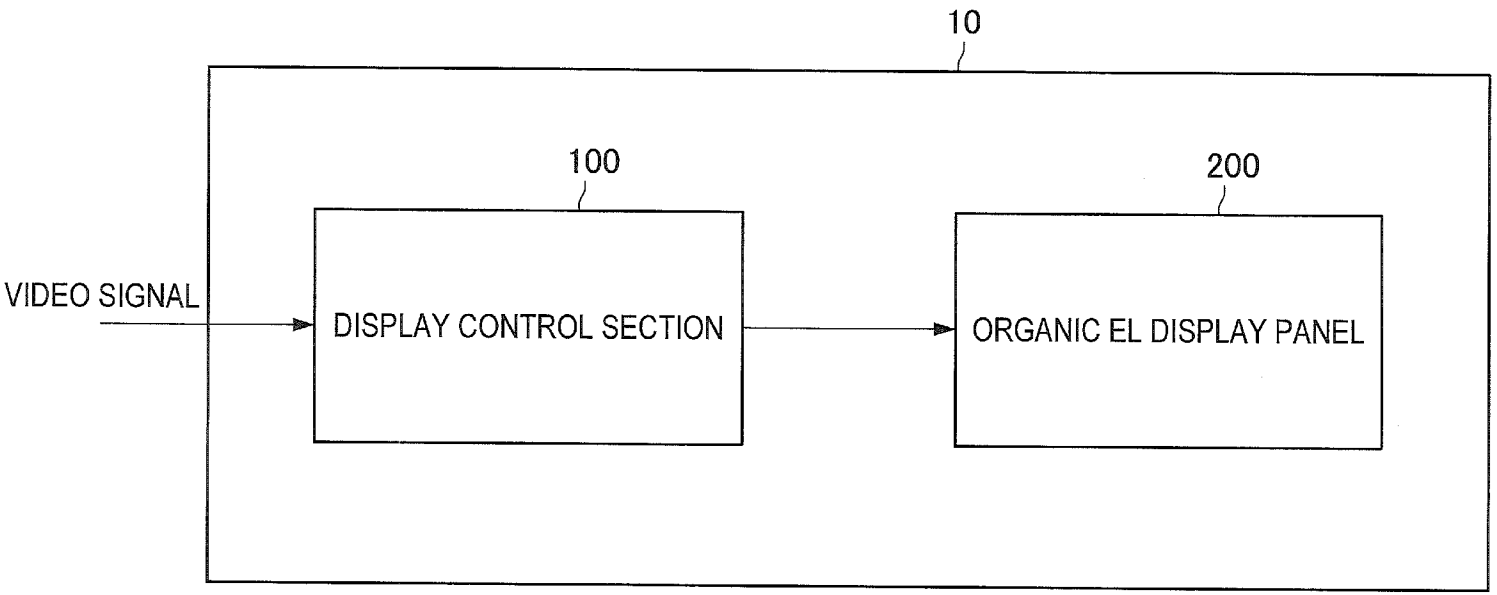
FIG. 1 is an explanatory diagram which describes a configuration example of a self-luminous display device 10 according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be given in the following order.

<1. The embodiments of the present disclosure>

[Configuration example of the self-luminous display device]

[Configuration example of the display control section]

[Operation examples of the self-luminous display device]

<2. Conclusion>

1. THE EMBODIMENTS OF THE PRESENT DISCLOSURE

Configuration Example of the Self-Luminous Display Device

First, a configuration example of a self-luminous display device according to an embodiment of the present disclosure will be described while referring to the figures. FIG. 1 is an explanatory diagram which describes a configuration example of a self-luminous display device 10 according to an embodiment of the present disclosure. Hereinafter, a configuration example of the self-luminous display device 10 according to an embodiment of the present disclosure will be described by using FIG. 1.

The self-luminous display device 10 shown in FIG. 1 is a device which displays a video on an organic EL display panel 200 using organic EL elements which emit light by the elements themselves when a voltage is applied. As shown in FIG. 1, the self-luminous display device 10 according to an embodiment of the present disclosure includes a display control section 100 and the organic EL display panel 200. When the supply of a video signal is received, the self-luminous display device 10 analyses this video signal, and displays a video via the organic EL display panel 200, by lighting pixels arranged within the organic EL display panel 200 in accordance with the analyzed contents.

The display control section 100 supplies, to the organic EL display panel 200, signals for displaying a video on the organic EL display panel 200, by applying a signal process to the video signal supplied to the self-luminous display device 10. For example, the signal process executed by the display control section 100 is a process which controls the luminance at the time when performing display, or is an image persistence prevention process for preventing image persistence of the screen on the organic EL display panel 200. A detailed configuration of the display control section 100 will be described later.

The organic EL display panel 200 is a display panel using organic EL elements which emit light by the elements themselves when a voltage is applied such as described above, and has a configuration in which the pixels of the organic EL elements are arranged in a matrix shape. While not illustrated in FIG. 1, the organic EL display panel 200 has a configuration, in which scanning lines which select pixels in a prescribed scanning period, data lines which provide luminance information for driving the pixels, and pixel circuits which control the current amount based on the luminance information and allow the organic EL elements to emit light by light emitting elements in accordance with the current amount, are arranged in a matrix, and by having such a configuration of the scanning lines, data lines and pixel circuits, the self-luminous display device 10 can display a video in accordance with a video signal.

The organic EL display panel 200 according to an embodiment of the present disclosure may be a display panel which displays images with the three primary colors of R (red), G (green) and B (blue), or may be a display panel which displays images with four colors which includes W (white) in addition to the three primary colors. In the following description, the organic EL display panel 200 according to an embodiment of the present disclosure will be described as a display panel which displays images with the four colors of R, G, B, W.

Heretofore, a configuration example of the self-luminous display device 10 according to an embodiment of the present disclosure has been described by using FIG. 1. Next, a configuration example of the display control section 100 included in the self-luminous display device 10 according to an embodiment of the present disclosure will be described.

[Configuration Example of the Display Control Section]

Figure 2:
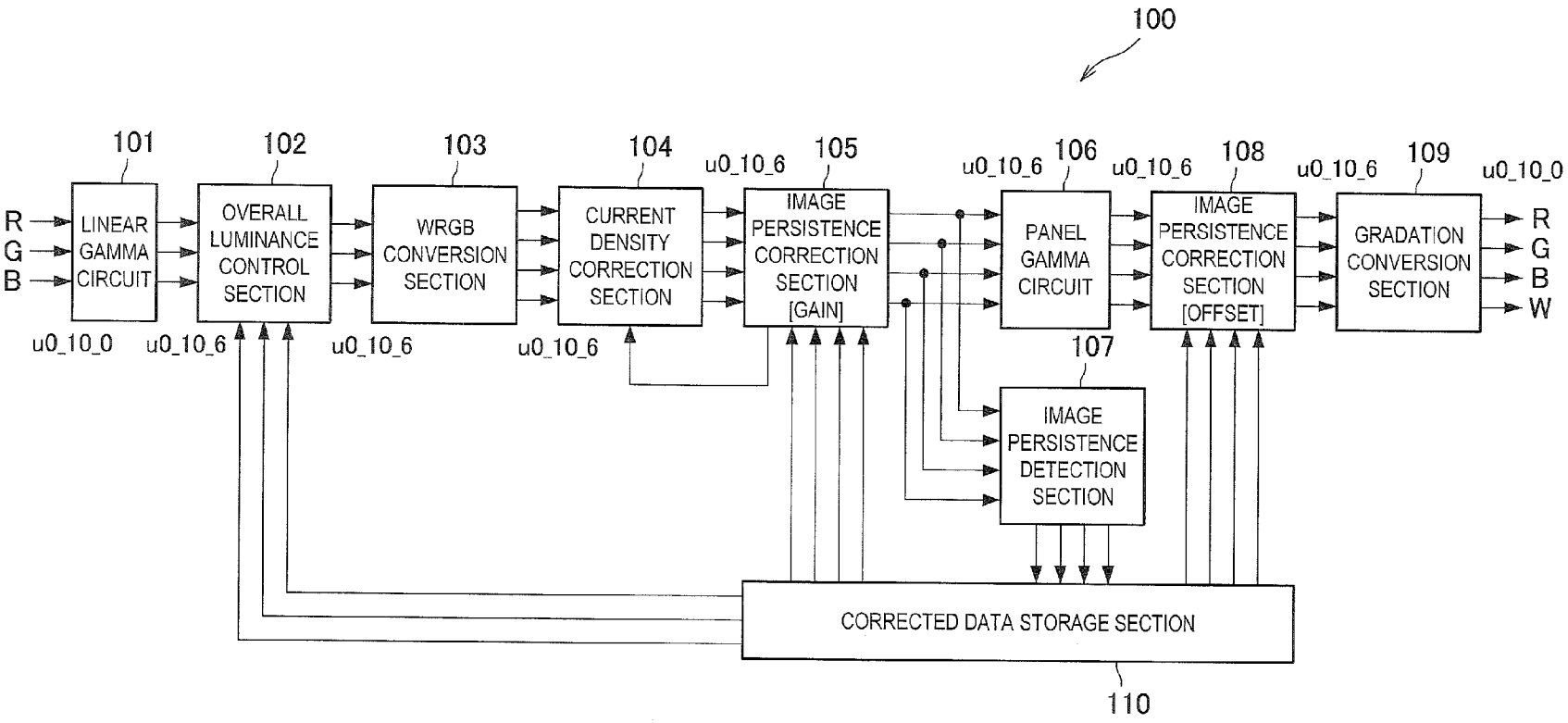
FIG. 2 is an explanatory diagram which shows a configuration example of a display control section 100.

FIG. 2 is an explanatory diagram which shows a configuration example of the display control section 100 included in the self-luminous display device 10 according to an embodiment of the present disclosure. Hereinafter, a configuration example of the display control section 100 included in the self-luminous display device 10 according to an embodiment of the present disclosure will be described by using FIG. 2.

As shown in FIG. 2, the display control section 100 according to an embodiment of the present disclosure includes a linear gamma circuit 101, an overall luminance control section 102, a WRGB conversion section 103, a current density correction section 104, image persistence correction sections 105 and 108, a gamma conversion section 106, an image persistence detection section 107, a gradation conversion section 109, and a corrected data storage section 110.

The linear gamma circuit 101 performs a signal process which converts a video signal, in which the output for an input has a gamma characteristic, so as to have a linear characteristic from the gamma characteristic. By performing a signal process in the linear gamma circuit 101 so that the output for an input has a linear characteristic, various processes for an image displayed on the organic EL display panel 200 become easy. The linear gamma circuit 101 supplies the signal after conversion to the overall luminance control section 102.

The overall luminance control section 102 executes control of an overall uniform luminance for the video signal supplied from the linear gamma circuit 101. While it will be specifically described later, the overall luminance control section 102 performs a control which decreases the uniform luminance for the video signal, by using corrected data stored in the corrected data storage section 110, prior to a gain control by the image persistence correction section 105, which will be described later. The overall luminance control section 102 supplies the video signal after luminance control to the WRGB conversion section 103.

The WRGB conversion section 103 converts the video signal to which luminance control has been performed into a video signal for displaying a video with the four colors of R, G, B, W on the organic EL display panel 200. The video signal converted by the WRGB conversion section 103 is supplied to the current density correction section 104.

The current density correction section 104 corrects the current density, by a signal process for the video signal supplied from the WRGB conversion section 103. The W pixels cause chromatic variations due to the gradations of the signal. The current density correction section 104 corrects the chromatic variations which occur by these W pixels. An example of a correction process by the current density correction section 104 will be described. The current density correction section 104 prepares a corrected LUT ($\Delta R$, $\Delta G$, $\Delta B$) in advance corresponding to the gradations of the W pixels, and adds the corrected values ($\Delta R$, $\Delta G$, $\Delta B$) acquired from the LUT for R, G, B within the video signal supplied from the WRGB conversion section 103. $\Delta R$, $\Delta G$, $\Delta B$ are corrected values which can take both positive and negative values.

The corrected values used in the correction process by the current density correction section 104 change due to deterioration of the pixels. Accordingly, the current density correction section 104 acquires a deterioration state of the W pixels by using the corrected data supplied from the image persistence correction section 105, and calculates corrected values by switching to the referred to corrected LUT in accordance with the deterioration state of the W pixels. The current density correction section 104 supplies the video signal after correction to the image persistence correction section 105.

The image persistence correction section 105 corrects image persistence, by applying a gain to the video signal supplied from the current density correction section 104 by using the corrected data stored in the corrected data storage section 110. By applying a gain to the video signal, the image persistence correction section 105 can display images without irregularities on the organic EL display panel 200, even in the case where image persistence has occurred. The image persistence correction section 105 supplies the video signal to which a gain has been applied to the panel gamma circuit 106 and the image persistence detection section 107.

The panel circuit 106 executes a process, for the video signal supplied from the image persistence correction section 105, which multiplies a characteristic gamma curved line of the organic EL display panel 200 by an inverse gamma curved line, in order to negate a VI characteristic of the transistors included in the organic EL display panel 200. The panel gamma circuit 106 supplies, to the image persistence correction section 108, the video signal after the process has been executed which multiplies a characteristic gamma curved line of the organic EL display panel 200 by an inverse gamma curved line.

The image persistence detection section 107 estimates a deterioration amount of the pixels, for the video signal supplied from the image persistence correction section 105, in the case where a video is displayed on the organic EL display panel 200 based on this video signal. When the deterioration amount of the pixels is estimated, the image persistence detection section 107 stores data derived from this estimated deterioration amount in the corrected data storage section 110 in order to be used as corrected data used by the image persistence correction sections 105 and 108. A configuration of the image persistence detection section 107 will be described later.

The image persistence correction section 108 corrects image persistence, by applying an offset to the video signal supplied from the panel gamma circuit 106 by using the corrected data stored in the corrected data storage section 110. The image persistence correction section 108 supplies the video signal to which an offset has been applied to the gradation conversion section 109.

The gradation conversion section 109 converts and outputs a gradation, for the video signal supplied from the image persistence correction section 108, so that the output video signal has a higher gradation than that of the input video signal. By converting the gradation so as to be at a higher gradation than that of the input, the gradation conversion section 109 can display a video with a high gradation on the organic EL display panel 200.

The corrected data storage section 110 stores the corrected data used in the luminance control process by the overall luminance control section 102 and the image persistence correction sections 105 and 108. While a detailed configuration will be described later, the corrected data storage section 110 includes, for example, a flash memory and a DDR SDRAM (Double-Data-Rate Synchronous Dynamic Random Access Memory). While the corrected data used in the luminance control process is stored in the flash memory such as described above, the corrected data storage section 110 reads out the corrected data stored in the flash memory to the DDR SDRAM, at the start time of the self-luminous display device 10, or at a prescribed timing after stating. The overall luminance control section 102 and the image persistence correction sections 105 and 108 use the corrected data read out to the DDR SDRAM when performing a luminance control process, and then when a deterioration amount of the pixels is estimated, the image persistence detection section 107 writes data derived from this deterioration amount to the DDR SDRAM.

Heretofore, a configuration example of the display control section 100 included in the self-luminous display device 10 according to an embodiment of the present disclosure has been described by using FIG. 2. To continue, a detailed configuration of each section included in the display control section 100 shown in FIG. 2 will be described.

Figure 3:
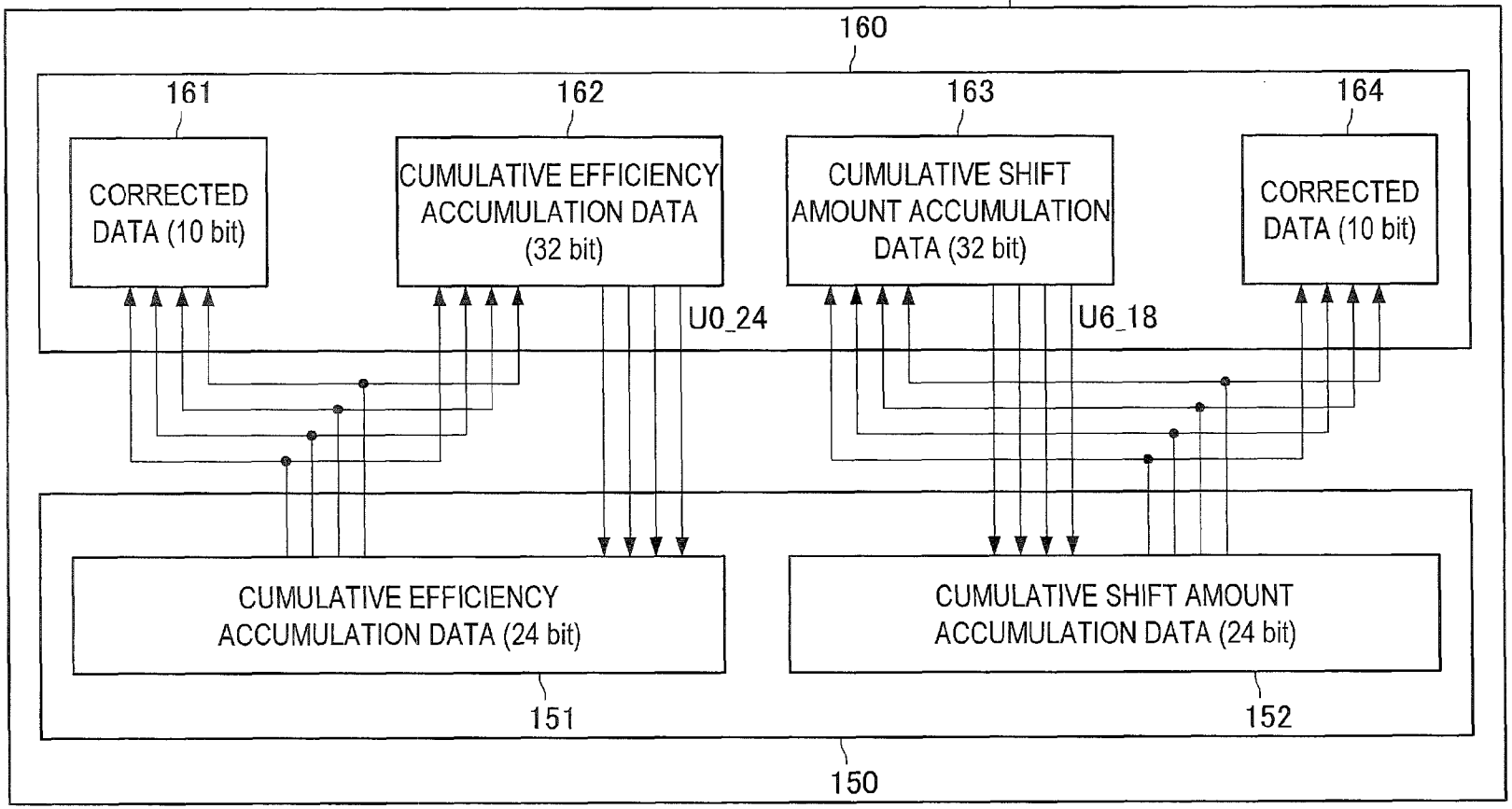
FIG. 3 is an explanatory diagram which shows a configuration example of a corrected data storage section 110 according to an embodiment of the present disclosure.

FIG. 3 is an explanatory diagram which shows a configuration example of the corrected data storage section 110 according to an embodiment of the present disclosure. Hereinafter, a configuration example of the corrected data storage section 110 according to an embodiment of the present disclosure will be described by using FIG. 3.

As shown in FIG. 3, the corrected data storage section 110 according to an embodiment of the present disclosure includes a flash memory 150 and a DDR SDRAM 160.

The flash memory 150 stores corrected data used in a luminance control process by the overall luminance control section 102 and the image persistence correction sections 105 and 108 such as described above. However, since the flash memory 150 generally takes time to write data, the flash memory 150 is unsuitable to successively update data generated by the image persistence detection section 107. Accordingly, the corrected data storage section 110 includes the DDR SDRAM 160 such as shown in FIG. 3. Since the DDR SDRAM 160 generally takes a short amount of time to write data when compared to the flash memory 150, the DDR SDRAM 160 is suitable to successively update data generated by the image persistence detection section 107.

Also, as shown in FIG. 3, cumulative efficiency accumulation data 151 and cumulative shift amount accumulation data 152 are stored in the flash memory 150, and corrected data 161 and cumulative efficiency accumulation data 162 based on the cumulative efficiency accumulation data 151, and cumulative shift amount accumulation data 163 and corrected data 164 based on the cumulative shift amount accumulation data 152, are stored in the DDR SDRAM 160.

As described above, the corrected data storage section 110 reads out the corrected data stored in the flash memory 150 to the DDR SDRAM 160, at the time when starting the self-luminous display device 10. In the present embodiment, the cumulative efficiency accumulation data 151 and the cumulative shift amount accumulation data 152 each have a bit length of 24 bits.

The cumulative efficiency accumulation data 151 has data of a bit length of 24 bits for each of the colors of R, G, B, and has data of a bit length of 24 bits for each of the Y component and the Z component of W. The cumulative shift amount accumulation data 152 has data of a bit length of 24 bits for each of the colors R, G, B, W. That is, the cumulative efficiency accumulation data 151 has 5 types of data, and the cumulative shift amount accumulation data 152 has 4 types of data.

The cumulative efficiency accumulation data 151 becomes cumulative efficiency accumulation data 162 of 32 bits, at the time of performing development of the DDR SDRAM 160, by having the upper 10 bits become corrected data 161 and adding a prescribed bit (for example "1") to the lower 8 bits. Similarly, the cumulative efficiency accumulation data 151 becomes cumulative shift amount accumulation data 163 of 32 bits, at the time of performing development of the DDR SDRAM 160, by having the upper 10 bits become corrected data 164 and adding a prescribed bit (for example "0") to the lower 8 bits.

Heretofore, a configuration example of the corrected data storage section 110 according to an embodiment of the present disclosure has been described by using FIG. 3. Next, a configuration example of the overall luminance control section 102 according to an embodiment of the present disclosure will be described.

Figure 4:
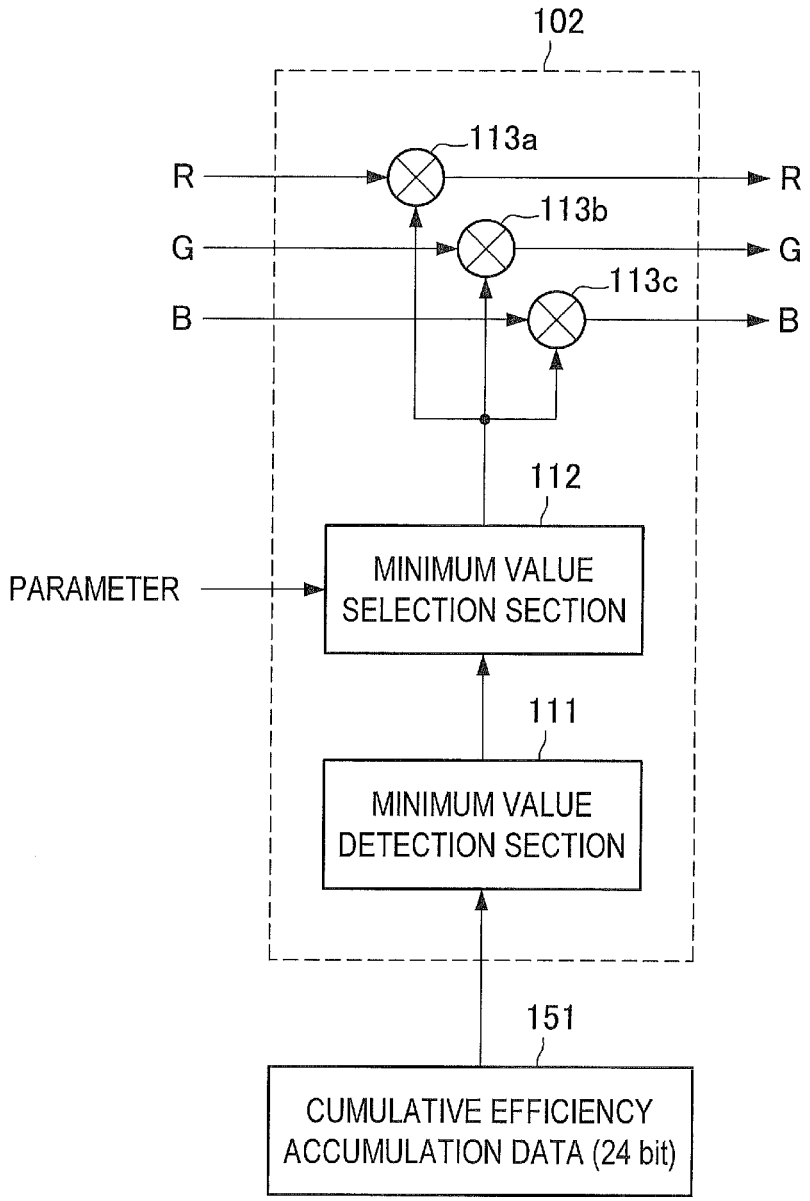
FIG. 4 is an explanatory diagram which shows a configuration example of an overall luminance control section 102 according to an embodiment of the present disclosure.

FIG. 4 is an explanatory diagram which shows a configuration example of the overall luminance control section 102 according to an embodiment of the present disclosure. The overall luminance control section 102 shown in FIG. 4 is constituted so as to execute a control which uniformly decreases the luminance of an input video signal over the entire screen, prior to an image persistence correction process by the image persistence correction section 105 of a later stage. As shown in FIG. 4, the overall luminance control section 102 according to an embodiment of the present disclosure includes a minimum value detection section 111, a minimum value selection section 112, and multipliers 113*a*, 113*b* and 113*c*.

The minimum value detection section 111 detects a minimum value from among the cumulative efficiency accumulation data 151 of R, G, B and the Y component of W, which are stored in the flash memory 150. By detecting a minimum value of the cumulative efficiency accumulation data 151, the minimum value detection section 111 can detect the pixels which have deteriorated the most. The minimum value detection section 111 supplies the minimum value of the cumulative efficiency accumulation data 151 to the minimum value selection section 112. Since the minimum value detection section 111 detects a minimum value from among the cumulative efficiency accumulation data 151 stored in the flash memory 150, a calculation of the minimum value is executed at the time of starting the self-luminous display device 10, and a fixed value obtained by this calculation is output to the minimum value selection section 112 when performing the overall luminance control.

The minimum value selection section 112 selects the minimum value and outputs the selected minimum value to the multipliers 113*a*, 113*b* and 113*c*, by using the smallest value and parameters of the cumulative efficiency accumulation data 151 supplied from the minimum value detection section 111. The multipliers 113*a*, 113*b* and 113*c* multiply a gain output from the minimum value selection section 112 by each of the signals of R, G, B, and outputs the multiplication result to the WRGB conversion section 103.

Heretofore, a configuration example of the overall luminance control section 102 according to an embodiment of the present disclosure has been described by using FIG. 4. Next, a configuration example of the image persistence correction section 105 according to an embodiment of the present disclosure will be described.

Figure 5:
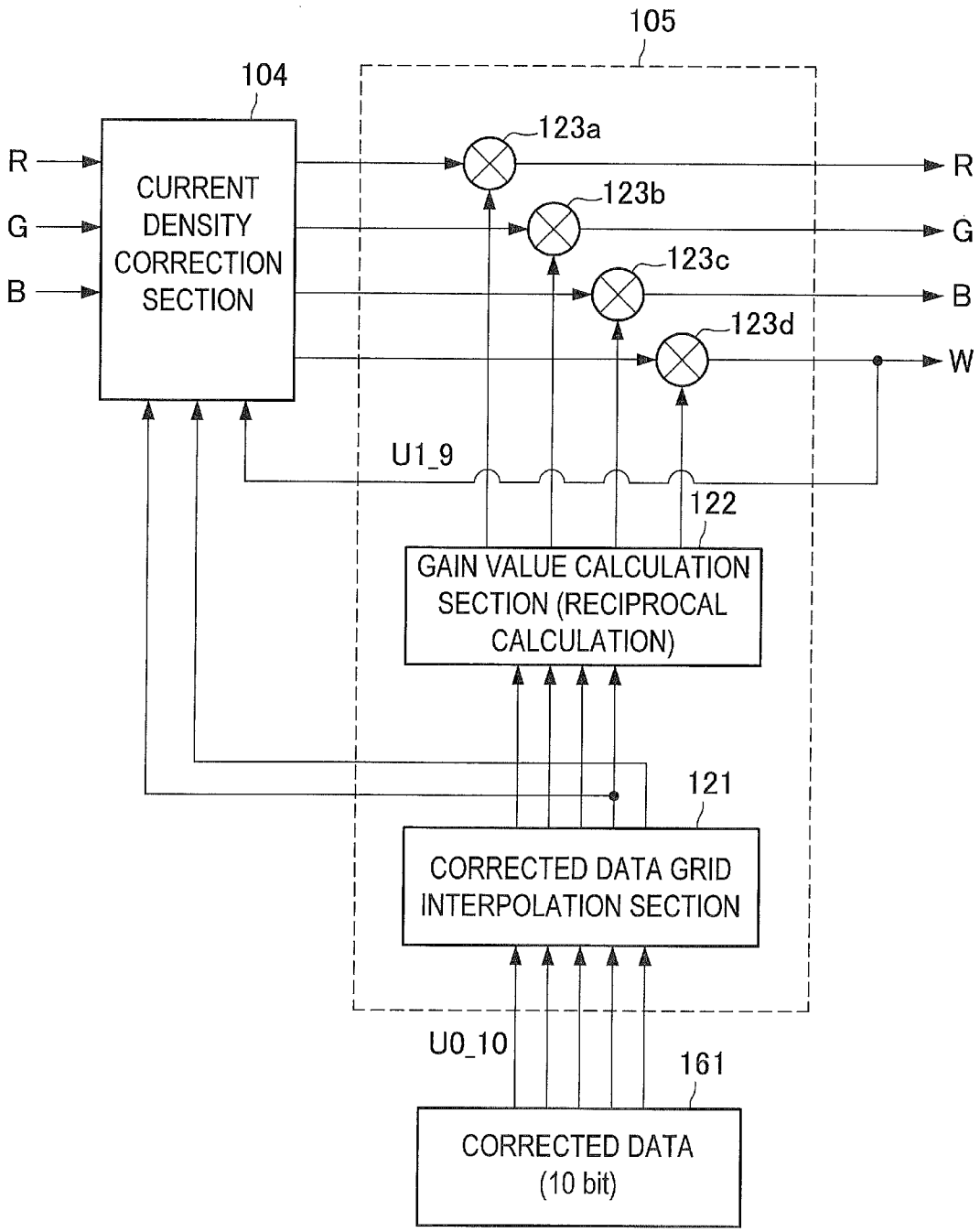
FIG. 5 is an explanatory diagram which shows a configuration example of an image persistence correction section 105 according to an embodiment of the present disclosure.

FIG. 5 is an explanatory diagram which shows a configuration example of the image persistence correction section 105 according to an embodiment of the present disclosure. The image persistence correction section 105 shown in FIG. 5 is constituted so as to correct image persistence by the application of a gain using the corrected data 161, for the video signal to which a control has been executed which uniformly decreases the luminance of the video signal over the entire screen. As shown in FIG. 5, the image persistence correction section 105 according to an embodiment of the present disclosure includes a corrected data grid interpolation section 121, a gain value calculation section 122, and multipliers 123*a*, 123*b*, 123*c* and 123*d*. Further, the current density correction section 104 is illustrated additionally in FIG. 5. Note that [ux_y(_z)] shows that there is y unsigned bit data, there is an accuracy of z bits, and values can be taken up to x bit times for an input by the application of the gain. That is, [u2_10_6] shows that there is 10 unsigned bit data, there is an accuracy of 6 bits, and values can be taken up 4 times for the input.

The corrected data grid interpolation section 121 executes an interpolation process for the corrected data 161. While it will be described later, the corrected data 161 is not present for all of the pixels, but is present for one pixel in a correction width of a prescribed grid shape. Therefore, in order to correct image persistence for all of the pixels, the corrected data grid interpolation section 121 develops corrected data 161 for all of the pixels by linear interpolation. The corrected data grid interpolation section 121 supplies corrected data after performing development for all of the pixels to the gain value calculation section 122. Further, from among the corrected data after performing development for all of the pixels, the corrected data grid interpolation section 121 supplies the corrected data of the Y component and Z component of W to the current density correction section 104.

The gain value calculation section 122 calculates a gain value which is applied to the video signal, by using the corrected data developed for all the pixels by the corrected data grid interpolation section 121. While the specific process will be described in detail later, the gain value calculation section 122 calculates a gain value which is applied to the video signal, by obtaining a reciprocal for the corrected data of the three colors of R, G, B and the Y component of W. When a gain value is calculated by obtaining a reciprocal for the corrected data of each of the three colors of R, G, B and the Y component of W, the gain value calculation section 122 outputs the gain value to each of the multipliers 123*a*, 123*b*, 123*c* and 123*d*.

The multipliers 123*a*, 123*b*, 123*c* and 123*d* multiply the gain number calculated from the corrected data of the three colors of R, G, B and the Y component of W by the gain value calculation section 122 to each of R, G, B, W, and output the multiplication result. The image persistence correction section 108 executes an image persistence correction process in a gamma space, by having the multipliers 123*a*, 123*b*, 123*c* and 123*d* uniformly multiply the corrected data of each color of R, G, B, W at each signal gradation, and output the multiplication result.

Heretofore, a configuration example of the image persistence correction section 105 according to an embodiment of the present disclosure has been described by using FIG. 5. Next, a configuration example of the image persistence detection section 107 according to an embodiment of the present disclosure will be described.

Figure 6:
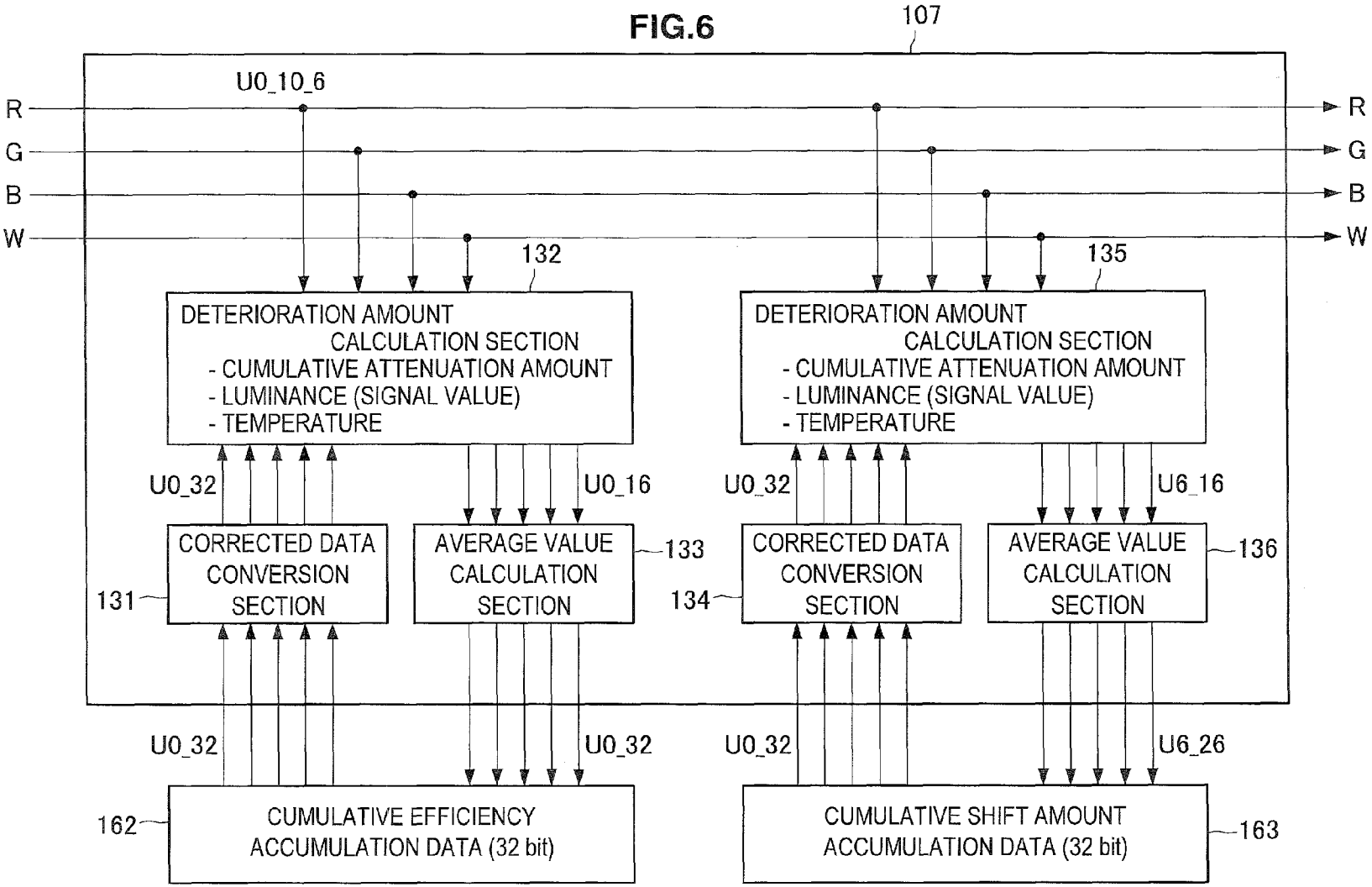
FIG. 6 is an explanatory diagram which shows a configuration example of an image persistence detection section 107 according to an embodiment of the present disclosure.

FIG. 6 is an explanatory diagram which shows a configuration example of the image persistence detection section 107 according to an embodiment of the present disclosure. The image persistence detection section 107 shown in FIG. 6 is configured so as to calculate how much each of the pixels have deteriorated due to the display of images based on a video signal, when a video signal after correction by the image persistence correction section 105 is displayed on the organic EL display panel 200.

As shown in FIG. 6, the image persistence detection section 107 according to an embodiment of the present disclosure includes corrected data conversion sections 131 and 134, deterioration amount calculation sections 132 and 135, and average value calculation sections 133 and 136.

The corrected data conversion section 131 develops the cumulative efficiency accumulation data 162 read out to the DDR SDRAM 160 for all of the pixels. Similarly, the corrected data conversion section 134 develops the cumulative shift amount accumulation data 163 read out to the DDR SDRAM 160 for all of the pixels. The corrected data conversion sections 131 and 134 develop each data by a process different to the interpolation process by the corrected data grid interpolation section 121 for all of the pixels. A development process of data by the corrected data conversion sections 131 and 134 will be described in detail later.

The deterioration amount calculation sections 132 and 135 calculate a deterioration amount when the video signal after correction by the image persistence correction section 105 is displayed on the organic EL display panel 200. Each of the deterioration amount calculation sections 132 and 135 has a look-up table which has a relation between the display time and the deterioration amount. While it will be described in detail later, the look-up table of the deterioration amount calculation section 132 is a two-dimensional look-up table which has inclinations of deterioration curves for efficiencies and gradations. Further, while it will be described in detail later, the look-up table of the deterioration amount calculation section 135 is a two-dimensional look-up table which has inclinations of deterioration curves for shift amounts and gradations.

When a deterioration amount is calculated when the video signal after correction by the image persistence correction section 105 is displayed on the organic EL display panel 200, the deterioration amount calculation section 132 subtracts, for each of the pixels, this calculated deterioration amount from the cumulative efficiency accumulation data 162 (called the cumulative efficiency prior to updating) developed for all of the pixels, by referring to the look-up table. The deterioration amount subtracted from the cumulative efficiency prior to updating will be called the cumulative efficiency after updating. When the cumulative efficiency after updating is obtained for each of the pixels, the deterioration amount calculation section 132 supplies the cumulative efficiency after updating to the average value calculation section 133.

When a deterioration amount is calculated when the video signal after correction by the image persistence correction section 105 is displayed on the organic EL display panel 200, the deterioration amount calculation section 135 adds, for each of the pixels, this calculated deterioration amount to the cumulative shift amount accumulation data 163 (called the cumulative shift amount prior to updating) developed for all of the pixels, by referring to the look-up table. The deterioration amount added to the cumulative shift amount prior to updating will be called the cumulative shift amount after updating. When the cumulative shift amount after updating is obtained for each of the pixels, the deterioration amount calculation section 135 supplies the cumulative shift amount after updating to the average value calculation section 136.

The average value calculation section 133 calculates an average value in a corrected width of a prescribed grid shape, for the cumulative efficiency after updating supplied from the deterioration amount calculation section 132. Similarly, the average value calculation section 136 calculates an average value in a corrected width of a prescribed grid shape, for the cumulative shift amount after updating supplied from the deterioration amount calculation section 135. Also, when an average value is obtained, the average value calculation sections 133 and 136 rewrite the cumulative efficiency accumulation data 162 and the cumulative shift amount accumulation data 163 stored in the DDR SDRAM 160 by the obtained average values, within a prescribed period (for example, within a vertical blanking period).

Heretofore, a configuration example of the image persistence detection section 107 according to an embodiment of the present disclosure has been described by using FIG. 6. Next, a configuration example of the image persistence correction section 108 according to an embodiment of the present disclosure will be described.

Figure 7:
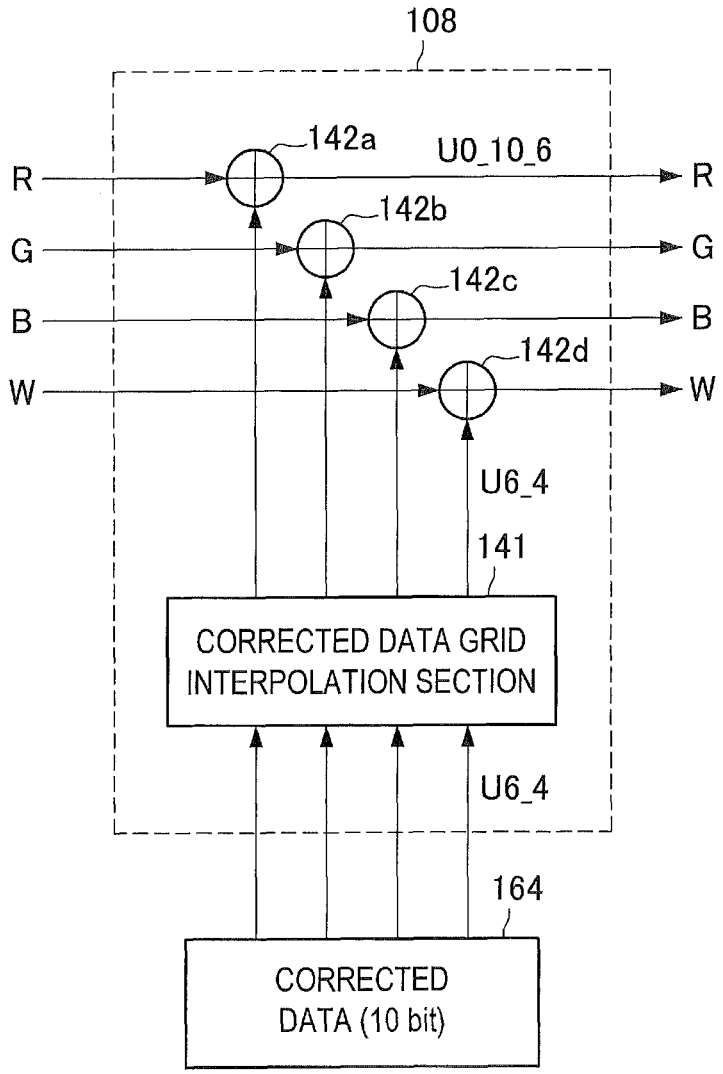
FIG. 7 is an explanatory diagram which shows a configuration example of an image persistence correction section 108 according to an embodiment of the present disclosure.

FIG. 7 is an explanatory diagram which shows a configuration example of the image persistence correction section 108 according to an embodiment of the present disclosure. The image persistence correction section 108 shown in FIG. 7 is constituted so as to add corrected data to the video signal supplied from the panel gamma circuit 106, and to output the addition result. As shown in FIG. 7, the image persistence correction section 108 according to an embodiment of the present disclosure includes a corrected data grid interpolation section 141, and adders 142*a*, 142*b*, 142*c* and 142*d*.

The corrected data grid interpolation section 141 executes an interpolation process for the corrected data 164 of each color of R, G, B, W. Similar to the corrected data 161, the corrected data 164 is not present for all of the pixels, but is present for one pixel in a correction width of a prescribed grid shape. Therefore, in order to correct image persistence for all of the pixels, the corrected data grid interpolation section 141 develops corrected data 164 for all of the pixels by linear interpolation. The corrected data grid interpolation section 141 supplies corrected data after performing development for all of the pixels to the adders 142*a*, 142*b*, 142*c* and 142*d*.

The adders 142*a*, 142*b*, 142*c* and 142*d* add corrected data of each color of R, G, B, W developed for all of the pixels by the corrected data grid interpolation section 141 to the video signal of each of R, G, B, W, and outputs the addition result. The image persistence correction section 108 executes an image persistence correction process in a gamma space, by having the adders 142*a*, 142*b*, 142*c* and 142*d* uniformly add the corrected data of each color of R, G, B, W at the overall signal gradation, and output the addition result.

Heretofore, a configuration example of the image persistence correction section 108 according to an embodiment of the present disclosure has been described by using FIG. 7. To continue, the operations of the self-luminous display device 10 according to an embodiment of the present disclosure will be described.

[Operation Examples of the Self-Luminous Display Device]

The self-luminous display device 10 according to an embodiment of the present disclosure executes a process which corrects image persistence in the display control section 100. An outline of a correction process of image persistence by the display control section 100 will be described by referring to the figures.

Figure 8:
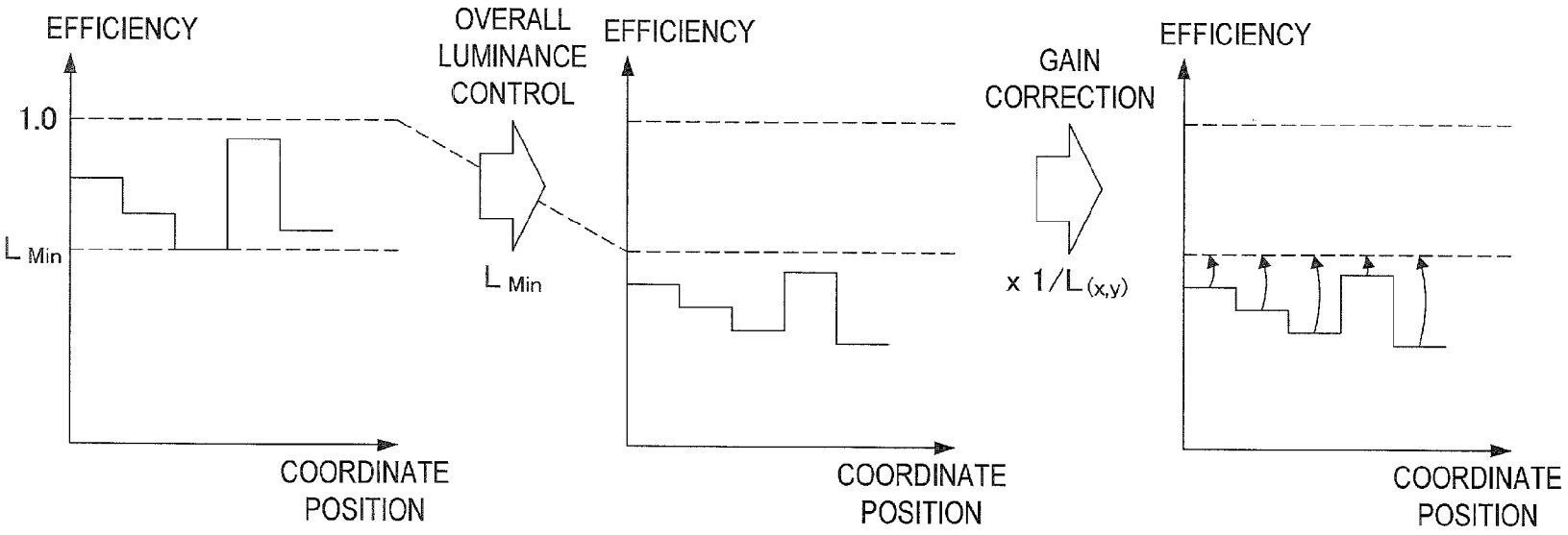
FIG. 8 is an explanatory diagram which shows an outline of an image persistence correction process by the display control section 100.

FIG. 8 is an explanatory diagram which shows an outline of a correction process of image persistence by the display control section 100. Three graphs are shown in FIG. 8. The vertical axis of each of the three graphs of FIG. 8 is a luminous efficiency which shows the extent of deterioration for the luminance of the pixels, and shows a time of 1.0 at which there is no deterioration. Further, the horizontal axis of each of the three graphs of FIG. 8 shows the coordinate position of some column (or row) in the organic EL display panel 200.

The graph on the left of FIG. 8 shows an example of a change in luminance for the pixels of some column (or row) in the organic EL display panel 200. While the luminous efficiency of the organic EL display panel 200 deteriorates when a video continues to be displayed, the extent of deterioration for this luminous efficiency will differ according to the pixels. Therefore, even if the same time of the video is displayed, the extent of deterioration for the luminous efficiency will differ according to the pixels due to differences in the luminance of this video. The graph on the left of FIG. 8 shows an example of a state in which the extent of luminous efficiency differs according to the pixels.

The correction process of image persistence by the display control section 100 is a process which corrects image persistence by matching the luminous efficiency to the luminous efficiency of the pixels which have the most deteriorated luminous efficiency. Therefore, in order to match the luminous efficiency to the luminous efficiency of the pixels which have the most deteriorated luminous efficiency, first, the display control section 100 uniformly multiplies the luminous efficiency Lmin of the most deteriorated pixels for all of the pixels. A state in which Lmin is uniformly multiplied for all of the pixels is the graph in the center of FIG. 8.

Then, in order to match the luminous efficiency to the luminous efficiency of the pixels which have the most deteriorated luminous efficiency, to continue, the display control section 100 multiplies the reciprocal 1/L (x,y) of the luminous efficiency L (x,y) for each pixel after deterioration. A state in which the reciprocal 1/L (x,y) of the luminous efficiency L (x,y) for each pixel after deterioration is the graph on the right of FIG. 8. By multiplying the reciprocal 1/L (x,y) of the luminous efficiency L (x,y) for each pixel after deterioration such as that of the graph on the right of FIG. 8, the luminous efficiency of all the pixels become matched to the luminous efficiency of the pixels which have the most deteriorated luminous efficiency.

The overall luminance control section 102 shown in FIGS. 2 and 4 is the section for executing the process which uniformly multiplies Lmin for all of the pixels. Also, the image persistence correction section 105 shown in FIGS. 2 and 5 is the section for executing the process which multiplies the reciprocal 1/L (x,y) of the luminous efficiency L (x,y) for each pixel.

The minimum value detection section 111 included in the overall luminance control section 102 is the section which searches for the luminous efficiency Lmin of the most deteriorated pixels. The gain value calculation section 122 included in the image persistence correction section 105 is the section which obtains the reciprocal 1/L (x,y) of the luminous efficiency L (x,y) for each pixel. Also, the multipliers 123*a*, 123*b*, 123*b* and 123*d* included in the image persistence correction section 105 are the sections for executing the process which multiplies the reciprocal 1/L (x,y) for each pixel.

The correction process of image persistence by the display control section 100 is represented by the following equation. $WRGBin_{(x,y)}$ represents the input video signal, and $WRGBout_{(x,y)}$ represents the output video signal.

$$WRGBout_{(x,y)} = WRGBin_{(x,y)} * \frac{L_{Min}}{L_{(x,y)}}$$

As described above, in order to match the luminous efficiency to the luminous efficiency of the pixels which have the most deteriorated luminous efficiency, a process is performed for all of the pixels which multiplies the reciprocal 1/L (x,y) of the luminous efficiency L (x,y) for each pixel. However, when data of the luminous efficiency is retained for all of the pixels, the data amount will become significant, and the cost of the flash memory 150 or the DDR SDRAM 160 for retaining the data amount will increase. Therefore, the cost of the flash memory 150 or the DDR SDRAM 160 for retaining the data amount is restrained, by having the self-luminous display device 10 according to the present embodiment hold one set of corrected data for a plurality of pixels.

Figure 9:
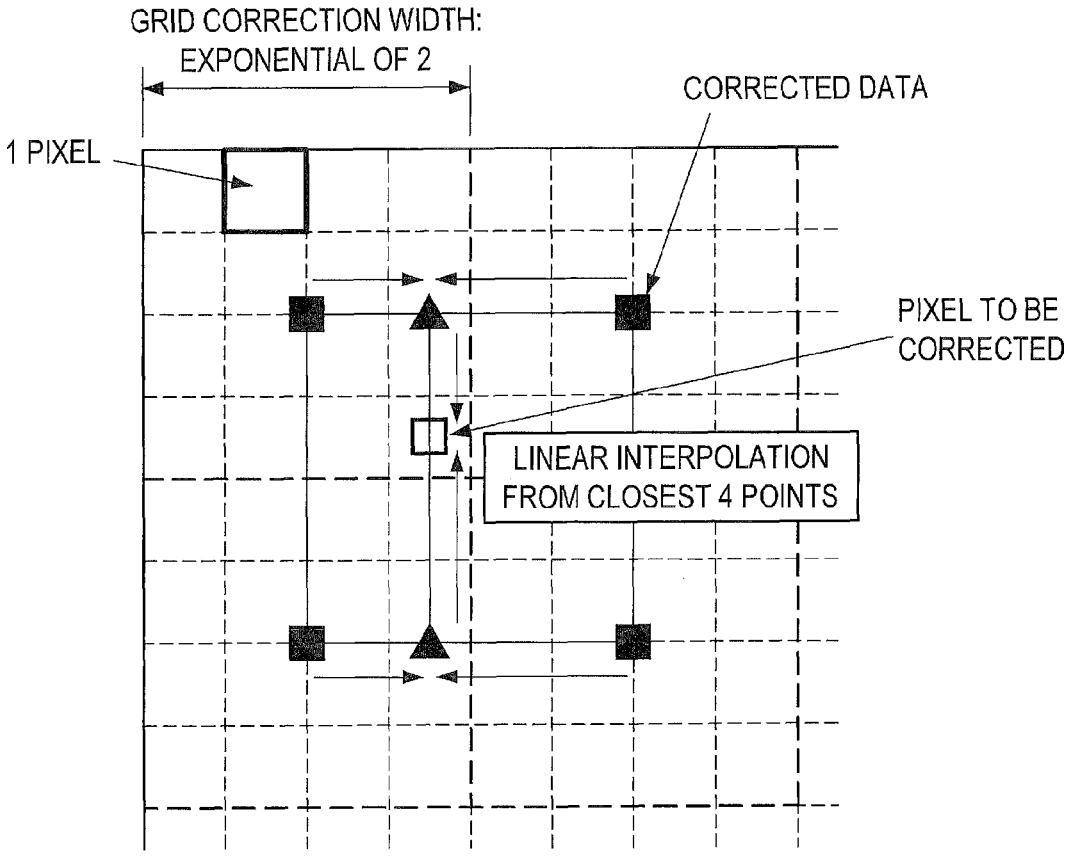
FIG. 9 is an explanatory diagram which shows an outline of a linear interpolation process of corrected data.

FIG. 9 is an explanatory diagram which shows an outline of a linear interpolation process of corrected data retained in the flash memory 150 or the DDR SDRAM 160. A case is shown in FIG. 9 where one set of corrected data is used for n vertical pixels×n horizontal pixels (n is an exponential of 2, and is n=2, 4, 8 or 16, for example).

In FIG. 9, one square indicates one pixel, and it is assumed that there is one grid in a range of n vertical pixels×n horizontal pixels. Further, the width of an n pixel part shown in FIG. 9 is called a grid correction width. The corrected data is positioned in the center of each grid, and the above described corrected data grid interpolation sections 121 and 141 perform linear interpolation of the four sets of corrected data closest to each of the pixels, when developing the corrected data for all of the pixels.

On the other hand, such as described above, the corrected data conversion sections 131 and 134 of the image persistence detection section 107 execute a process which develops the corrected data in each grid for all of the pixels within these grids, without performing linear interpolation by the corrected data grid interpolation sections 121 and 141.

Figure 10:
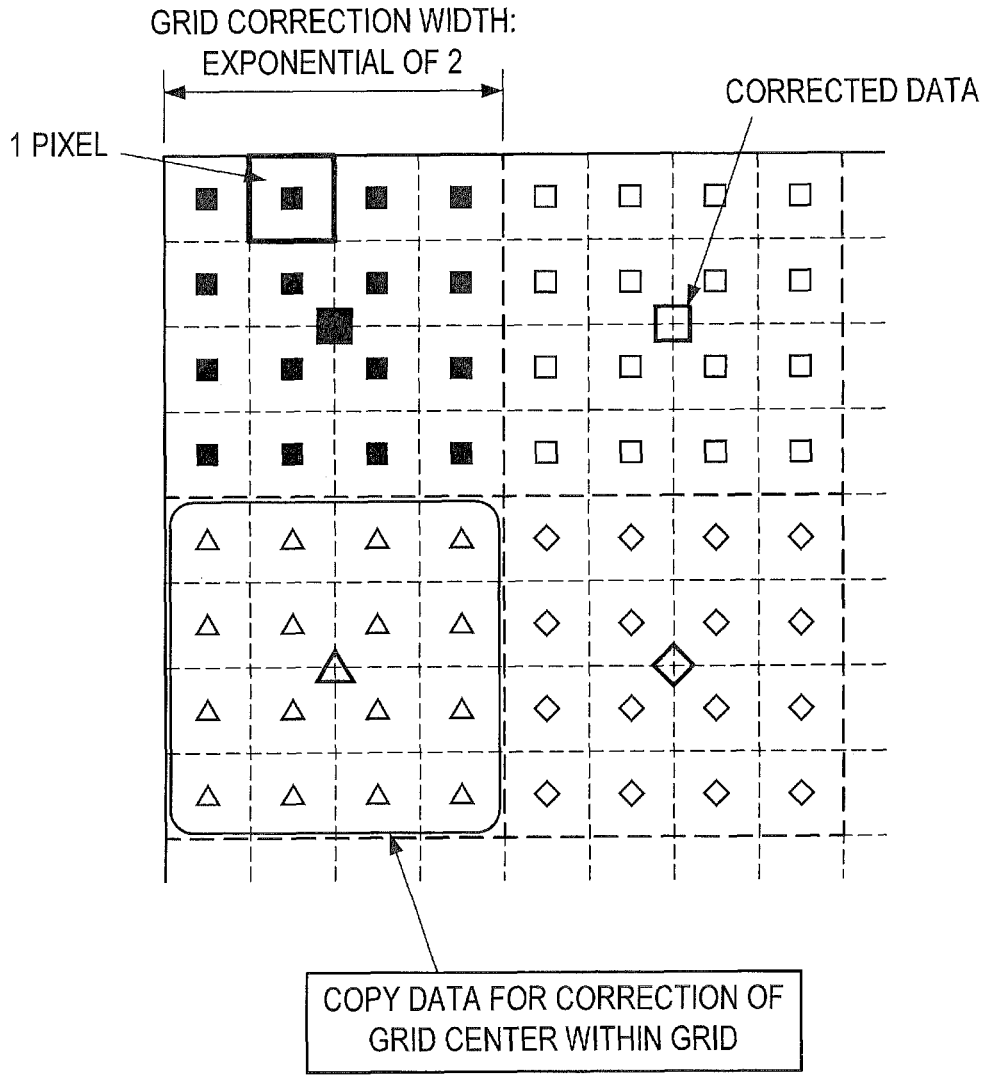
FIG. 10 is an explanatory diagram which shows an outline of an up-conversion process of corrected data.

FIG. 10 is an explanatory diagram which shows an outline of an up-conversion process of the corrected data retained in the flash memory 150 or the DDR SDRAM 160. As shown in FIG. 10, the corrected data conversion sections 131 and 134 execute a process which develops corrected data in each grid for all of the pixels within these grids. That is, the corrected data conversion sections 131 and 134 execute a process which copies the corrected data in each grid for the pixels within these grids. The corrected data conversion sections 131 and 134 may use, for example, a 0-order hold as a process which copies the corrected data in each grid for the pixels within these grids.

Figure 11:
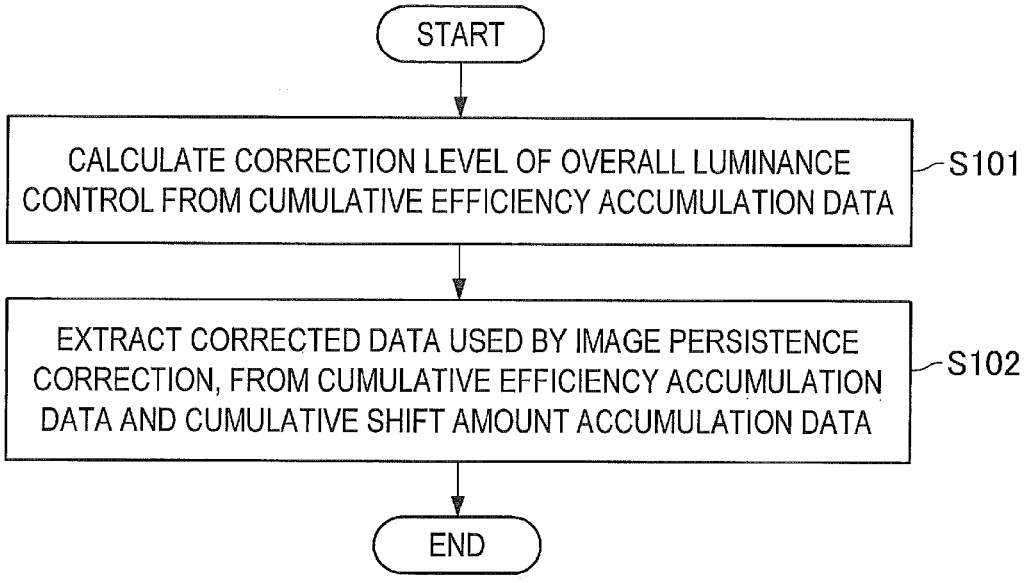
FIG. 11 is a flow chart which shows the operations of the display control section 100 according to an embodiment of the present disclosure.

To continue, the flow of the correction process of image persistence by the display control section 100 will be described. FIG. 11 is a flow chart which shows the operations of the display control section 100 according to an embodiment of the present disclosure. The flow chart shown in FIG. 11 shows the processes executed by the display control section 100 when the self-luminous display device 10 is started.

When the correction process of image persistence is executed, first, the display control section 100 calculates a correction level for overall luminance control, from the cumulative efficiency accumulation data 151 (step S101). This calculation of a correction level for overall luminance control is executed by having the minimum value detection section 111 search for a luminous efficiency Lmin of the most deteriorated pixels, such as described above.

When a correction level for overall luminance control is calculated from the cumulative efficiency accumulation data 151 in the above described step S101, to continue, the display control section 100 extracts corrected data used in image persistence correction, from the cumulative efficiency accumulation data 151 and the cumulative shift amount accumulation data 152 stored in the flash memory 150 (step S102). This process which extracts corrected data of step S102 is a process, for the corrected data storage section 110, which reads out the cumulative efficiency accumulation data 151 and the cumulative shift amount accumulation data 152 stored in the flash memory 150 to the DDR SDRAM 160, and develops the read out cumulative efficiency accumulation data 151 and cumulative shift amount accumulation data 152.

As described above, the cumulative efficiency accumulation data 151 becomes cumulative efficiency accumulation data 162 of 32 bits, at the time of performing development of the DDR SDRAM 160, by having the upper 10 bits become corrected data 161 and adding a prescribed bit (for example "1") to the lower 8 bits. Similarly, the cumulative efficiency accumulation data 151 becomes cumulative shift amount accumulation data 163 of 32 bits, at the time of performing development of the DDR SDRAM 160, by having the upper 10 bits become corrected data 164 and adding a prescribed bit (for example "0") to the lower 8 bits.

Figure 12:
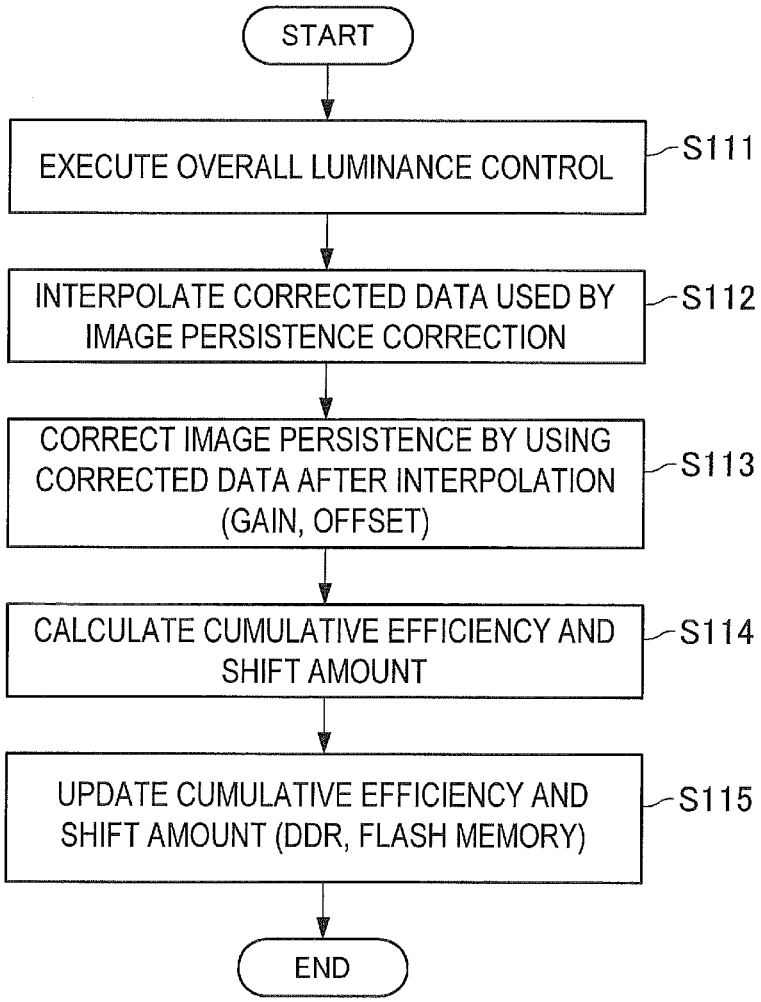
FIG. 12 is a flow chart which shows the operations of the display control section 100 according to an embodiment of the present disclosure.

FIG. 12 is a flow chart which shows the operations of the display control section 100 according to an embodiment of the present disclosure. The flow chart shown in FIG. 12 shows the operations when executing a process which corrects image persistence in the display control section 100 during the start of the self-luminous display device 10.

When correcting image persistence, the display control section 100 executes a signal process such as uniformly decreasing the luminance of the entire screen for an input video signal, by using the correction level for overall luminance control calculated in the above described step S101 (step S111). This signal process of step S111 is executed by the overall luminance control section 102.

As described above, the minimum value detection section 111 obtains a luminous efficiency Lmin of the most deteriorated pixels. Also, the multipliers 113*a*, 113*b*, 113*c* and 113*d* multiply the luminous efficiency Lmin by the video signal for each of the pixels, and output the multiplication result.

When a signal process is executed such as uniformly decreasing the luminance of the entire screen for a video signal input to the display control section 100 in the above described step S111, to continue, the display control section 100 interpolates corrected data for correcting image persistence for the video signal to which the signal process has been executed (step S112).

As described above, in the present embodiment, since corrected data is prepared in grid units and not in pixel units, corrected data is interpolated in step S112 in order to convert to corrected data for all of the pixels. Such an interpolation process of step S112 is executed by the corrected data grid interpolation sections 121 and 141, such as described above.

When a process which interpolates the corrected data is executed in the above described step S112, to continue, the display control section 100 executes an image persistence correction process using the corrected data developed for all of the pixels by interpolation (step S113). This image persistence correction process is executed by the image persistence correction sections 105 and 108.

As described above, by having the image persistence correction section 105 apply a gain to the video signal, the luminous efficiency of all of the pixels can be matched to the luminous efficiency of the pixels which have the most deteriorated luminous efficiency. Further, the image persistence correction section 108 corrects image persistence by adding an offset amount to the video signal of a gamma space.

When the image persistence correction process using corrected data developed for all of the pixels is executed in the above described step S113, to continue, the display control section 100 calculates a cumulative efficiency and a cumulative shift amount, by using the video signal to which image persistence has been corrected by the image persistence correction section 105 (step S114). The calculation of a cumulative efficiency and a cumulative shift amount of step S114 is executed by the image persistence detection section 107.

When a cumulative efficiency and a cumulative shift amount are calculated in the above described step S114, to continue, the display control section 100 updates the calculated cumulative efficiency and shift amount in the DDR SDRAM 160 (step S115). Further, the display control section 100 also updates the calculated cumulative efficiency and shift amount in the frame memory 150 at prescribed intervals. The update process of the cumulative efficiency and shift amount of step S115 is executed by the image persistence detection section 107.

By executing the above described processes from step S111 to step S115 in each frame, the display control section 100 can display a video, in which an emission balance of each of the pixels does not collapse, on the organic EL display panel 200, even if the luminous efficiency by the display of the video decreases differently in each of the pixels.

Heretofore, while the flow of a correction process of image persistence by the display control section 100 has been described, the self-luminous display device 10 according to an embodiment of the present disclosure has the feature, in the calculation of a cumulative efficiency and a cumulative shift amount of the above described step S114, in which this calculation accuracy is improved. To continue, a calculation process of a cumulative efficiency and a cumulative shift amount, at the time when performing the correction process of image persistence by the display control section 100, will be described in more detail.

While a luminous efficiency of the organic EL display panel 200 using organic EL elements for the pixels deteriorates when a video continues to be displayed, the extent of deterioration of this luminous efficiency will differ according to the pixels. This is because even if the same time of the video is displayed, deterioration characteristics will differ in accordance with the luminance of this video. Accordingly, in the present embodiment, deterioration characteristics for a plurality of gradations are retained in the deterioration amount calculation sections 132 and 135, and a cumulative efficiency and a cumulative shift amount are obtained with an improved accuracy by calculating deterioration amounts corresponding to the gradations.

First, an example of deterioration characteristics will be shown for a plurality of gradations, which are retained in the deterioration amount calculation section 132. FIG. 13 is an explanatory diagram which shows a look-up table of deterioration characteristics for a plurality of gradations, which are retained in the deterioration amount calculation section 132, and FIG. 14 is an explanatory diagram which shows deterioration characteristics for a plurality of gradations, which correspond to those of the look-up table shown in FIG. 13.

Figure 14:
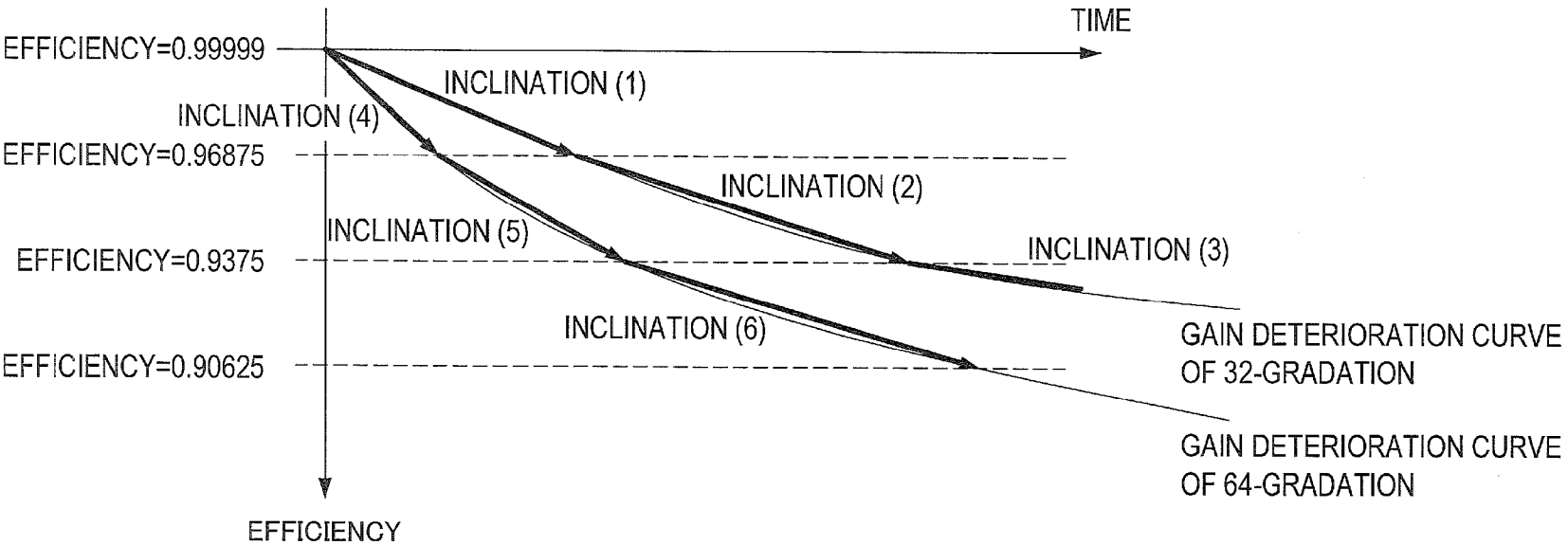
FIG. 14 is an explanatory diagram which shows deterioration characteristics for a plurality of gradations, which correspond to those of the look-up table shown in FIG. 13.

A gain deterioration curve of a 32-gradation and a gain deterioration curve of a 64-gradation are shown in FIG. 14, in the case where the gradations are shown in 10 bits (a 1024-gradation). As shown in FIG. 14, the curve of a 64-gradation has a faster deterioration pace than that of the curve of a 32-gradation.

In the present embodiment, there is the feature in which a cumulative efficiency is calculated, by dividing a gain deterioration curve by a plurality of efficiencies, and approximating the divided curve by a straight line having fixed inclinations at the divided sections. FIG. 14 shows the gain deterioration curve of a 32-gradation approximated by a straight line of an inclination (1), and the gain deterioration curve of a 64-gradation approximated by a straight line of an inclination (4), between efficiencies from 99999 (≈1) up to 0.96875.

Similarly, the gain deterioration curve of a 32-gradation is approximated by a straight line of an inclination (2), and the gain deterioration curve of a 64-gradation is approximated by a straight line of an inclination (5), between efficiencies from 0.96875 up to 0.9375. Also, the gain deterioration curve of a 32-gradation is approximated by a straight line of an inclination (3), and the gain deterioration curve of a 64-gradation is approximated by a straight line of an inclination (6), between efficiencies from 0.9375 up to 0.90625.

The look-up table shown in FIG. 13 is a look-up table which provides a relation of the inclinations corresponding to the gradations and the efficiencies. The deterioration amount calculation section 132 obtains a gradation of the supplied video signal, multiplies a light emission time by an inclination corresponding to this gradation, and obtains a cumulative efficiency after updating, by subtracting the multiplication result from a cumulative efficiency prior to updating.

In the present embodiment, the inclinations stored in the look-up table shown in FIG. 13 have a bit length of 16 bits. Also, the look-up table is a table of each of the three temperatures of a low temperature, a standard temperature and a high temperature prepared for the five components of the Y component of R, G, B, W and the Z component of W. Further, the grid points of the look-up table are the 11 points for the gradations of 0/32/64/128/256/384/512/640/768/896/1024, and are the 16 points for the efficiencies of 1(0.99999)/0.96875/0.9375/0.90625/0.875/0.84375/0.8125/0.78125/0.75/0.71875/0.6875/0.65625/0.625/0.59375/0.5625/0.53125. Of course, it is needless to say that the values and numbers of the grid points are not limited to such an example.

Next, an example of deterioration characteristics will be shown for a plurality of gradations, which are retained in the deterioration amount calculation section 135. FIG. 15 is an explanatory diagram which shows a look-up table of deterioration characteristics for a plurality of gradations, which are retained in the deterioration amount calculation section 135, and FIG. 16 is an explanatory diagram which shows deterioration characteristics for a plurality of gradations, which correspond to those of the look-up table shown in FIG. 15.

Figure 16:
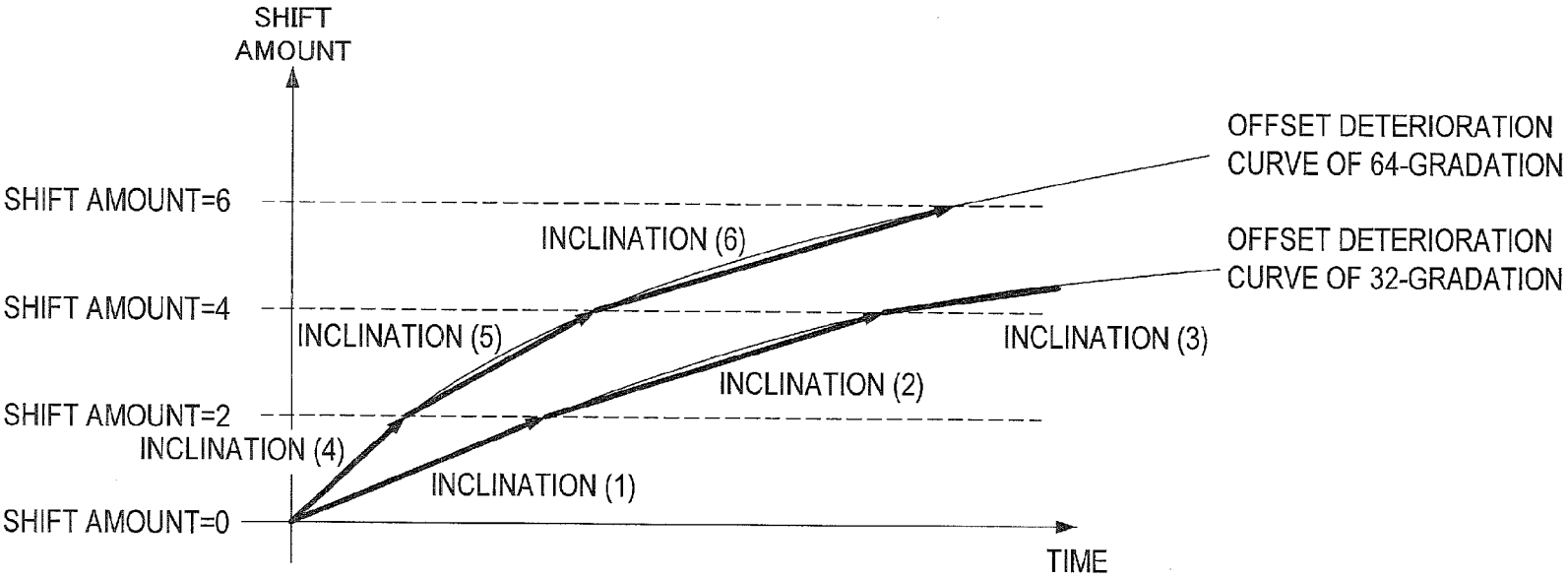
FIG. 16 is an explanatory diagram which shows deterioration characteristics for a plurality of gradations, which correspond to those of the look-up table shown in FIG. 15.

An offset deterioration curve of a 32-gradation and an offset deterioration curve of a 64-gradation are shown in FIG. 16, in the case where the gradations are shown in 10 bits (a 1024-gradation). As shown in FIG. 14, the curve of a 64-gradation has a faster deterioration pace than that of the curve of a 32-gradation.

In the present embodiment, there is a feature in which a cumulative efficiency is calculated, by dividing an offset deterioration curve by a plurality of efficiencies, and approximating the divided curve by a straight line having fixed inclinations at the divided sections. FIG. 14 shows the offset deterioration curve of a 32-gradation approximated by a straight line of an inclination (1), and the offset deterioration curve of a 64-gradation approximated by a straight line of an inclination (4), between shift amounts from 0 up to 2.

Similarly, the offset deterioration curve of a 32-gradation is approximated by a straight line of an inclination (2), and the offset deterioration curve of a 64-gradation is approximated by a straight line of an inclination (5), between shift amounts from 2 up to 4. Also, the offset deterioration curve of a 32-gradation is approximated by a straight line of an inclination (3), and the offset deterioration curve of a 64-gradation is approximated by a straight line of an inclination (6), between shift amounts from 4 up to 6.

In the present embodiment, the inclinations stored in the look-up table shown in FIG. 15 have a bit length of 16 bits. Also, the look-up table is a table of each of the three temperatures of a low temperature, a standard temperature and a high temperature prepared for the four colors of R, G, B, W. Further, the grid points of the look-up table are the 11 points for the gradations of 0/32/64/128/256/384/512/640/768/896/1024, and are the 32 points for the shift amounts of 0/2/4/6/8/10/12/14/16/18/20/22/24/26/28/30/32/34/36/38/40/42/44/46/48/50/52/54/56/58/60/62. Of course, it is needless to say that the values and the numbers of grid points are not limited to such an example.

The look-up tables shown in FIGS. 13 and 15 may be used differently, in the case where a two-dimensional video is displayed or in the case where a three dimensional video is displayed, on the organic EL display panel 200. Further, a plurality of coefficients may be prepared to be used when performing a calculation of the cumulative efficiency or the cumulative shift amount, which will be described later. For example, the image persistence detection section 107 may select a group (of efficiency coefficients or shift amount coefficients) from among the three groups of (Dg1, Do1), (Dg2, Do2) and (Dg3, Do3). Note that while the range of the efficiency coefficients and the shift amount coefficients are arbitrary, the ranges may be take values between 0-4, for example.

To continue, a calculation process of a cumulative efficiency by the image persistence detection section 107 will be described in detail. In the description hereinafter, a calculation process of a cumulative efficiency by the image persistence detection section 107 will be described by including examples, in the case where a video signal of a 64-gradation is supplied to the image persistence detection section 107.

Figure 17:
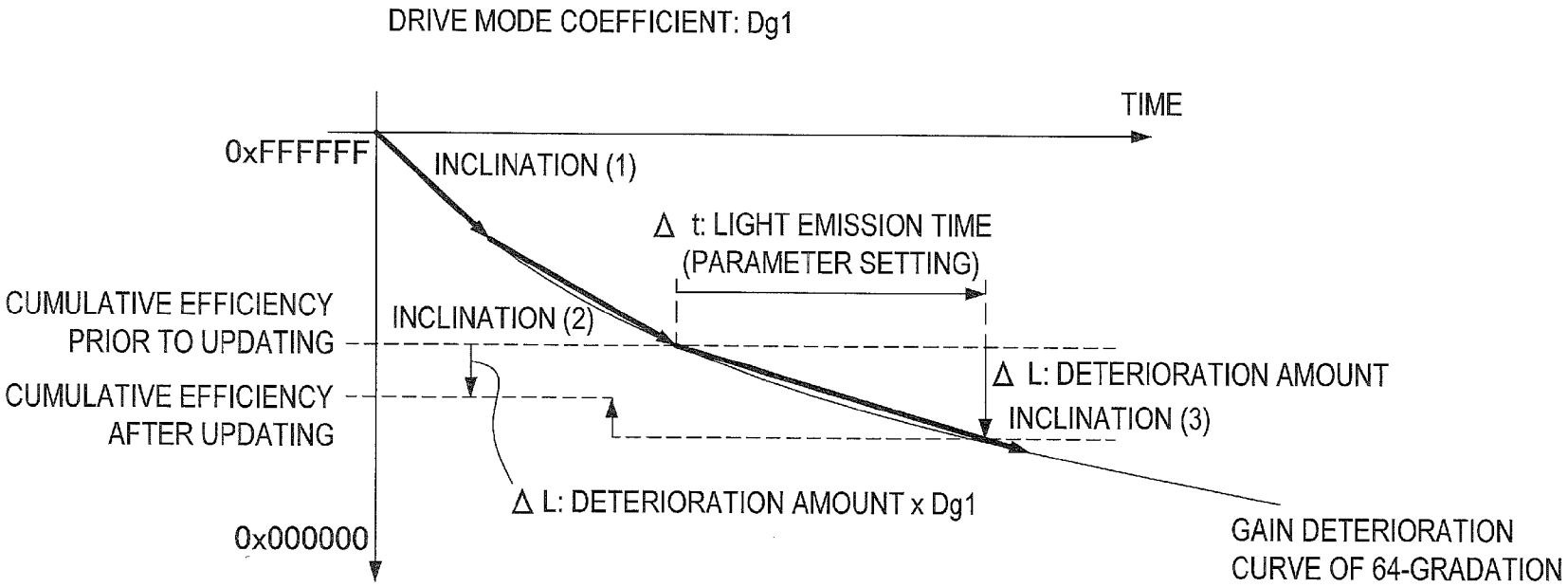
FIG. 17 is an explanatory diagram which describes a calculation process of a cumulative efficiency by the image persistence detection section 107.

FIG. 17 is an explanatory diagram which describes a calculation process of a cumulative efficiency by the image persistence detection section 107. A gain deterioration curve of a 64-gradation is shown in the graph of FIG. 17. Further, an efficiency coefficient used in the calculation process of a cumulative efficiency by the image persistence detection section 107 is assumed to be Dg1.

The deterioration amount calculation section 132 obtains a cumulative efficiency prior to updating for target pixels, from the corrected data to which up-conversion has been performed by the corrected data conversion section 131. To continue, the deterioration amount calculation section 132 derives, from the look-up table shown in FIG. 13, an inclination of the deterioration curve of a 64-gradation in the cumulative efficiency prior to updating. For example, as shown in FIG. 17, the deterioration amount calculation section 132 refers to the look-up table, and derives, with the inclination (3), an inclination of the deterioration curve of a 64-gradation in the cumulative efficiency prior to updating.

When an inclination of the deterioration curve of a 64-gradation is derived, to continue, the deterioration amount calculation section 132 calculates a deterioration amount $\Delta L$, by multiplying a light emission time $\Delta t$ by the derived inclination. When the deterioration amount $\Delta L$ is calculated, to continue, the deterioration amount calculation section 132 calculates a cumulative efficiency prior to updating by subtracting the efficiency coefficient multiplied by Dg1 in the calculated deterioration amount $\Delta L$ from the cumulative efficiency prior to updating.

When the cumulative efficiency after updating is calculated by the deterioration amount calculation section 132, the average value calculation section 133 obtains an average value of the cumulative efficiency after updating within the grid, and updates the cumulative efficiency accumulation data 162 stored in the DDR SDRAM 160 with this average value, in a prescribed period (for example, a vertical blanking period).

By executing the above described process, the image persistence detection section 107 can update the cumulative efficiency accumulation data 162 stored in the DDR SDRAM 160. While the above described description is for a process in the case where corresponding gradations are stored in the look-up table, a case can also be considered in which information of a gradation for a video signal supplied to the image persistence detection section 107 is not stored in the look-up table. In the case where information of a gradation for a video signal supplied to the image persistence detection section 107 is not stored in the look-up table, the deterioration amount calculation section 132 obtains an inclination of this gradation by performing linear interpolation of the inclinations stored in the look-up table.

Figure 18:
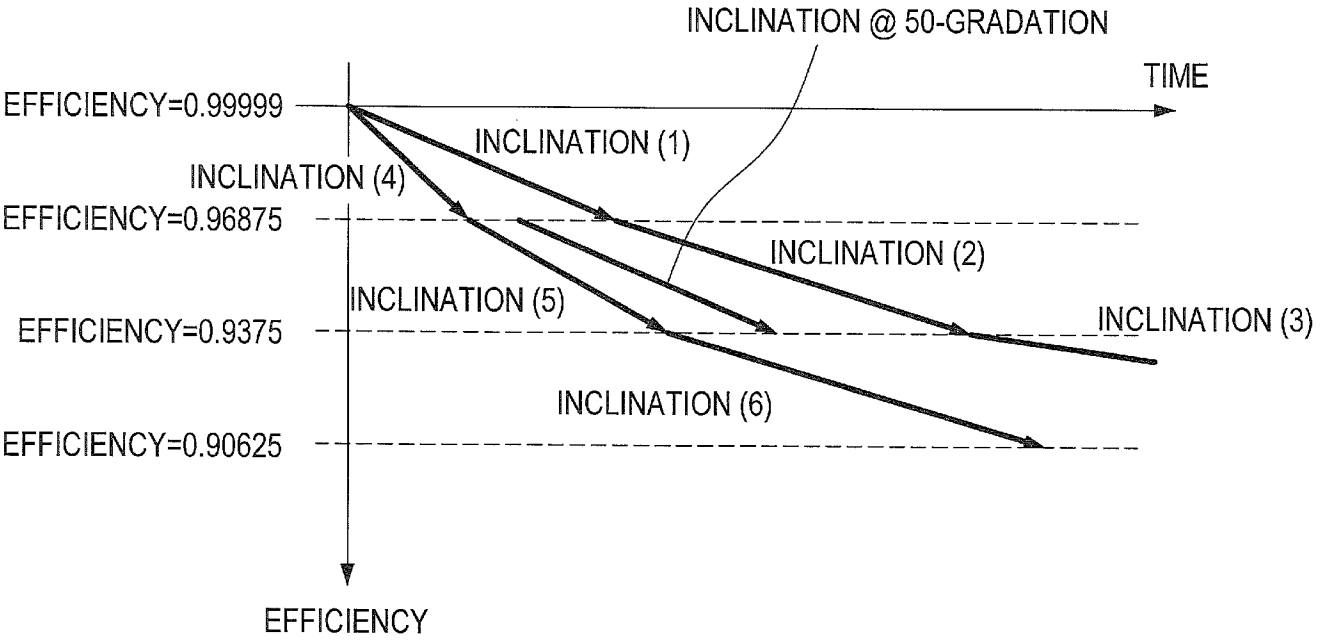
FIG. 18 is an explanatory diagram which describes a calculation process of a cumulative efficiency by the image persistence detection section 107.

In the description hereinafter, a calculation process of a cumulative efficiency by the image persistence detection section 107, in the case where the cumulative efficiency prior to updating is 0.95 and a video signal of a 50-gradation is supplied to the image persistence detection section 107, will be described by including examples. FIG. 18 is an explanatory diagram which describes a calculation process of a cumulative efficiency by the image persistence detection section 107. Gain deterioration curves of a 32-gradation and a 64-gradation are shown in the graph of FIG. 18.

Since the cumulative efficiency prior to updating is 0.95, the deterioration amount calculation section 132 selects the axis with an efficiency of 0.96875 from the look-up table shown in FIG. 13. Also, since the gradation of the video signal is a 50-gradation, the deterioration amount calculation section 132 selects the axis of a 32-gradation and the axis of a 64-gradation from the look-up table shown in FIG. 13. That is, in the case where the cumulative efficiency prior to updating is 0.95 and a video signal of a 50-gradation is supplied to the image persistence detection section 107, the deterioration amount calculation section 132 selects the inclination (2) and the inclination (5) from the look-up table shown in FIG. 13.

Figure 19:
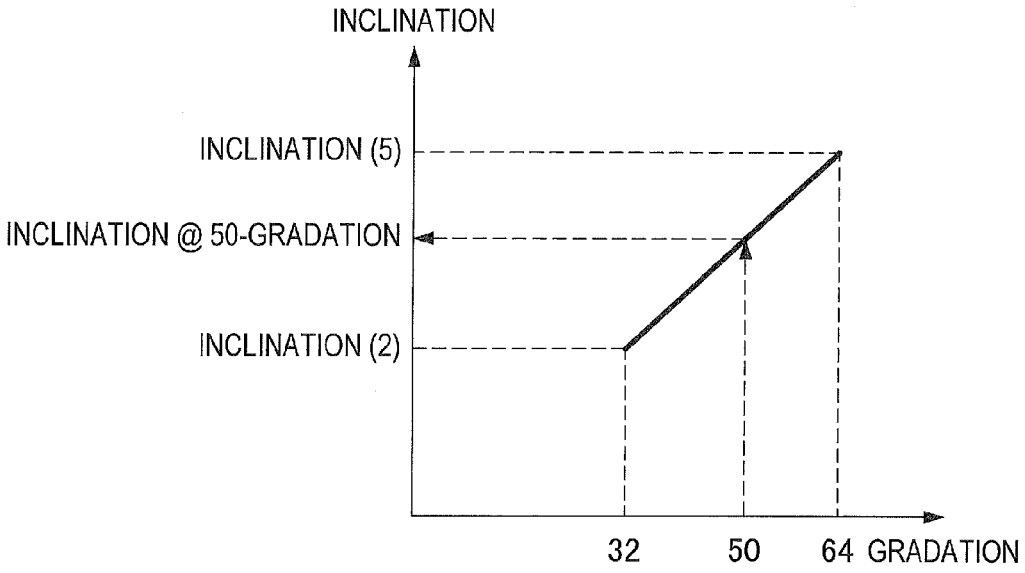
FIG. 19 is an explanatory diagram which shows a graph when obtaining an inclination in a 50-gradation by linear interpolation.
Figure 20:
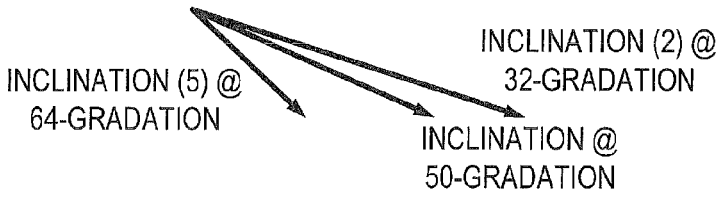
FIG. 20 is an explanatory diagram which shows a relation of inclinations.

When the inclination (2) and the inclination (5) are selected from the look-up table shown in FIG. 13, the deterioration amount calculation section 132 obtains an inclination in a 50-gradation by linear interpolation, which is shown in FIG. 18, by using the inclination (2) and the inclination (5). FIG. 19 is an explanatory diagram which shows a graph when the deterioration amount calculation section 132 obtains an inclination in a 50-gradation by linear interpolation. As shown in FIG. 19, the inclination when the gain deterioration curve is approximated by a straight line is set to change at a fixed inclination, between a 32-gradation and a 64-gradation, and the deterioration amount calculation section 132 calculates the inclination in a 50-gradation. FIG. 20 is an explanatory diagram which shows a relation between the inclination (2) in a 32-gradation, the inclination (5) in a 64-gradation, and the inclination in a 50-gradation obtained from the inclination (2) and the inclination (5).

Similar to the case of the processes for the above described 64-gradation, when an inclination in a 50-gradation is calculated, the deterioration amount calculation section 132 calculates a deterioration amount ΔL, by multiplying a light emission time Δt by the inclination, and calculates a cumulative efficiency after updating by subtracting the efficiency coefficient multiplied by Dg1 in the calculated deterioration amount ΔL from the cumulative efficiency prior to updating.

In this way, in the case where information of a gradation of the video signal supplied to the image persistence detection section 107 is not stored in the look-up table, the deterioration amount calculation section 132 can obtain an inclination stored in the look-up table by linear interpolation, and can calculate the cumulative efficiency after updating by using this obtained inclination.

Figure 21:
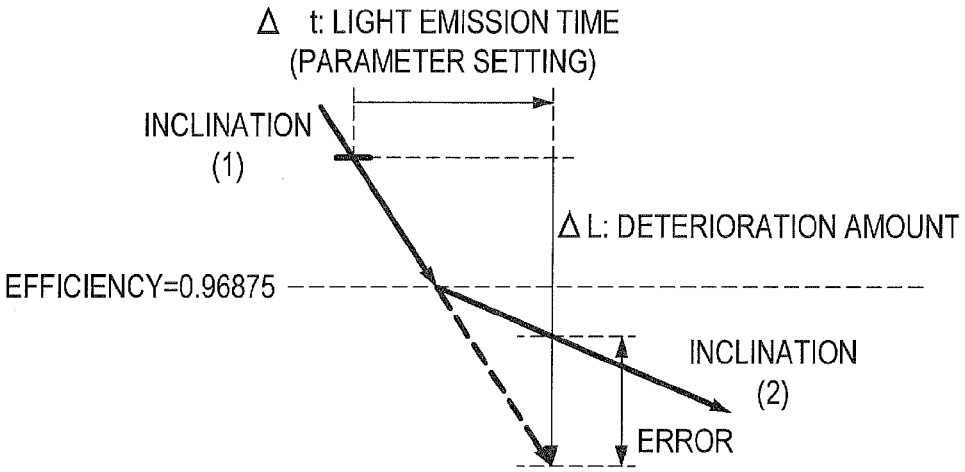
FIG. 21 is an explanatory diagram which shows an example in the case where the grid of the look-up table is crossed over.

While the cumulative efficiency after updating is calculated such as described above, a case can also be considered in which the grid of the look-up table is crossed over as a result of the advancement of the light emission time Δt, when the cumulative efficiency after updating is calculated by the image persistence detection section 107. FIG. 21 is an explanatory diagram which shows an example in the case where the grid of the look-up table is crossed over as a result of the advancement of the light emission time Δt, when the cumulative efficiency after updating is calculated by the image persistence detection section 107. The example shown in FIG. 21 is for the case where the cumulative efficiency after updating crosses over the grid 0.96875 for the efficiency of the look-up table as a result of the advancement of the light emission time Δt.

In this way, in the case where a grid of the look-up table is crossed over as a result of the advancement of the light emission time Δt, the deterioration amount calculation section 132 calculates a deterioration amount ΔL by using the inclination of the cumulative efficiency prior to updating. In the example shown in FIG. 21, the deterioration amount calculation section 132 calculates a deterioration amount ΔL by using the inclination (1) of the cumulative efficiency prior to updating. By calculating a deterioration amount ΔL by using an inclination of the cumulative efficiency prior to updating, an error deviating from the original gain deterioration curve will occur, such as shown in FIG. 21. However, for the sake of convenience in the example shown in FIG. 21, in the case where the inclination changes significantly before and after the efficiency=0.96875, the light emission time Δt will actually be an extremely small value, and even if an error does occurs, this error will be at a level which can be disregarded.

As described above, the look-up table referred to by the deterioration amount calculation section 132 is a table of each of the three temperatures of a low temperature, a standard temperature and a high temperature prepared for the five components of the Y component of R, G, B, W and the Z component of W. That is, the deterioration amount calculation section 132 calculates a cumulative efficiency by changing the inclination of the gain deterioration curve in accordance with the temperature, even if at the same gradation.

The image persistence detection section 107 according to the present embodiment sets a correspondence for the temperature by using a parameter which is called a temperature parameter. The temperature parameter is a parameter which can take values between 0-255, for example, and a relation between the temperature parameter and the actual temperature is capable of being set by software.

Figure 22:
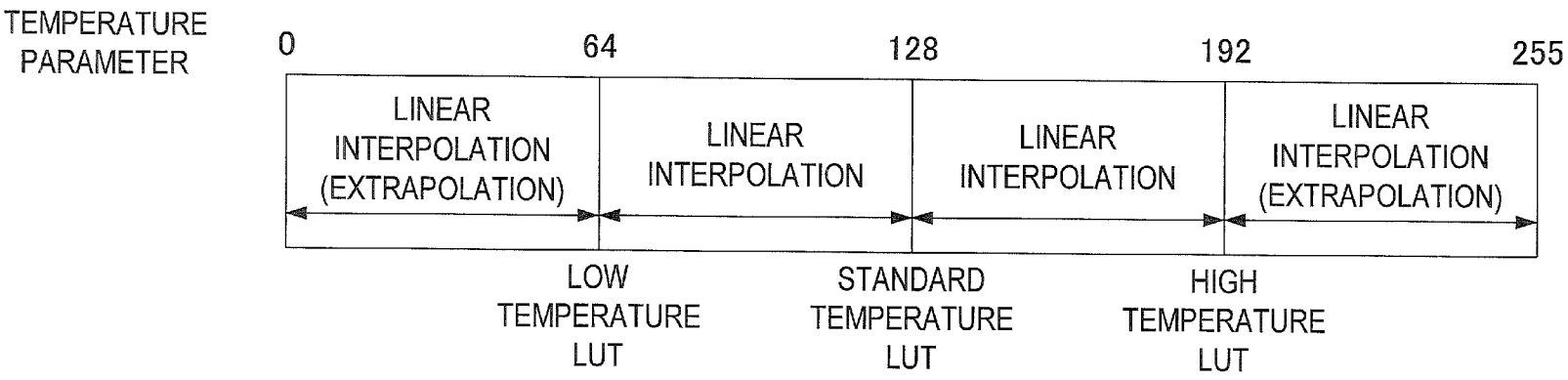
FIG. 22 is an explanatory diagram which shows a relation between a temperature parameter and a look-up table.

FIG. 22 is an explanatory diagram which shows a relation between the temperature parameter and a look-up table. In the case where the temperature parameter is set as a parameter which can take values between 0-255, the deterioration amount calculation section 132 refers to a look-up table of the low temperature in the case where the temperature parameter is 64, such as shown in FIG. 22. Further, the deterioration amount calculation section 132 refers to a look-up table of the standard temperature in the case where the temperature parameter is 128, and the deterioration amount calculation section 132 refers to a look-up table of the high temperature in the case where the temperature parameter is 192. Further, in the case where the temperature parameter is a value other than 64, 128 or 192, the deterioration amount calculation section 132 determines an inclination by linear interpolation.

For example, in the case where the value of the temperature parameter is 150, the deterioration amount calculation section 132 obtains an inclination by linear interpolation from the look-up table of the standard temperature and the look-up table of the high temperature. In addition, in the case where the value of the gradation is not stored in the look-up tables, an inclination is calculated in this gradation by linear interpolation, such as described above.

Figure 23:
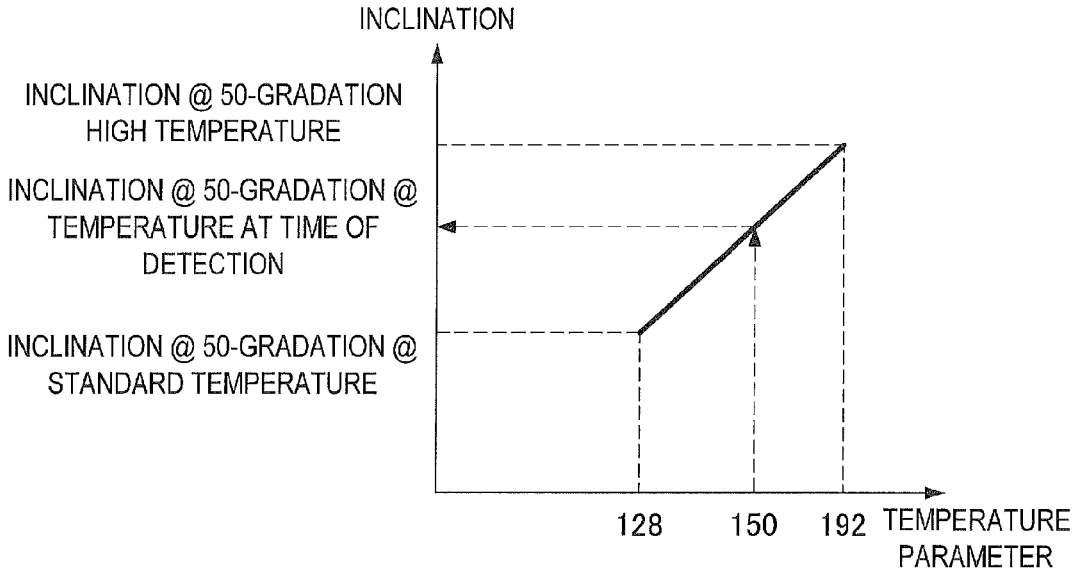
FIG. 23 is an explanatory diagram which shows a graph when a deterioration amount calculation section 132 obtains inclinations by linear interpolation in the case where the value of the temperature parameter is 150.

FIG. 23 is an explanatory diagram which shows a graph when the deterioration amount calculation section 132 obtains an inclination by linear interpolation, in the case where the value of the temperature parameter is 150. As shown in FIG. 23, a value of the temperature parameter is set in which an inclination of a 50-gradation changes by a fixed inclination, between 128 and 192, and the deterioration amount calculation section 132 calculates an inclination in the case where the value of the temperature parameter is 150.

The image persistence detection section 107 detects a deterioration amount for a specified line, and detects successive deterioration amounts from the top to the bottom of the screen by a line successive scan. The speed of this line successive scan is capable of being set by a parameter in frame units. The image persistence detection section 107 continues cumulative addition by continuing to perform detection at a specified line by moving to the next line. Also, the image persistence detection section 107 acquires cumulative efficiency accumulation data 162 from the DDR SDRAM 160, at a timing which moves to the next line.

Figure 24:
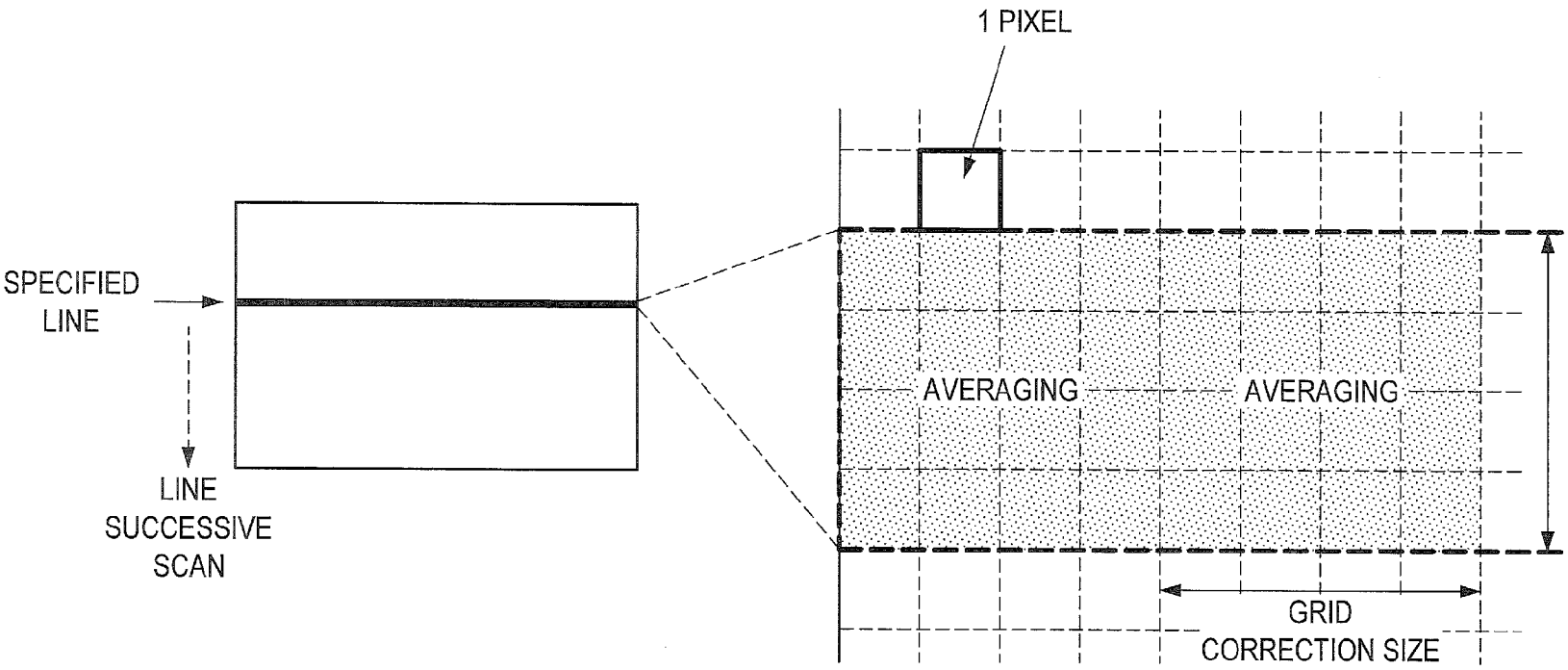
FIG. 24 is an explanatory diagram which shows averaging in grid units of the cumulative efficiency.

As described above, the image persistence detection section 107 averages the cumulative efficiency in grid units, when updating the cumulative efficiency accumulation data 162 to the DDR SDRAM 160. FIG. 24 is an explanatory diagram which shows averaging in grid units of the cumulative efficiency, by the image persistence detection section 107. As described above, the image persistence detection section 107 detects a deterioration amount for a specified line, and detects successive deterioration amounts from the top to the bottom of the screen by a line successive scan. Also, as shown in FIG. 24, the image persistence detection section 107 averages the cumulative efficiency in grid units, when updating the cumulative efficiency accumulation data 162 to the DDR SDRAM 160.

The display control section 100 according to the present embodiment expresses an efficiency 0.9999~0.5 of the cumulative efficiency accumulation data by 0xFFFFFF~0x000000. Therefore, the cumulative efficiency accumulation data is subtracted from the initial value 0xFFFFFF, and updating is stopped at the time when 0x000000 is reached.

Figure 25:
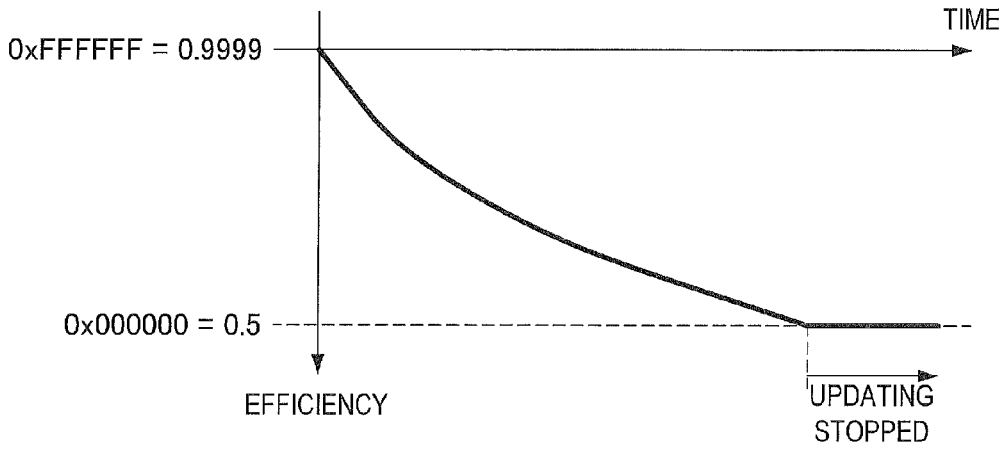
FIG. 25 is an explanatory diagram which shows, by a graph, a state in which cumulative efficiency accumulation data is updated.

FIG. 25 is an explanatory diagram which shows, by a graph, a state in which the cumulative efficiency accumulation data is updated. The display control section 100 subtracts the cumulative efficiency accumulation data from the initial value 0xFFFFFF, such as shown in FIG. 25. However, when the cumulative efficiency accumulation data reaches 0x000000, the display control section 100 stops the updating of the cumulative efficiency accumulation data.

While a calculation process of the cumulative efficiency accumulation data by the deterioration amount calculation section 132 has been described in the description up to here, a calculation process of the cumulative shift amount accumulation data by the deterioration amount calculation section 135 is capable of being executed by a process similar to the calculation process of the cumulative efficiency accumulation data.

Also, the display control section 100 according to the present embodiment expresses a shift amount 0~64 (≈63.9999) of the cumulative shift amount accumulation data by 0x000000~0xFFFFFF. Therefore, the cumulative shift amount accumulation data is added to the initial value 0x000000, and updating is stopped at the time when 0xFFFFFF is reached.

Figure 26:
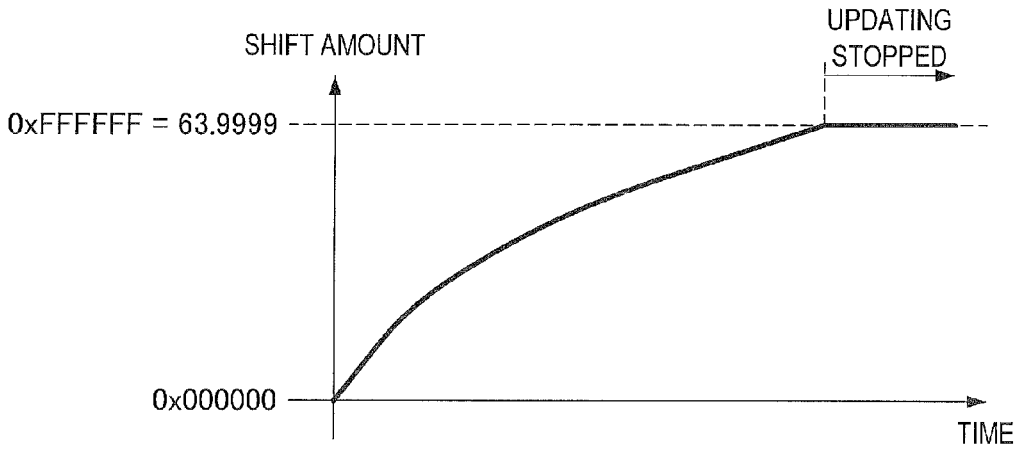
FIG. 26 is an explanatory diagram which shows, by a graph, a state in which cumulative shift amount accumulation data is updated.

FIG. 26 is an explanatory diagram which shows, by a graph, a state in which the cumulative shift amount accumulation data is updated. The display control section 100 adds the cumulative shift amount accumulation data to the initial value 0x000000, such as shown in FIG. 26. However, when the cumulative shift amount accumulation data reaches 0xFFFFFF, the display control section 100 stops the updating of the cumulative efficiency accumulation data.

By performing a calculation of the cumulative efficiency accumulation data and the cumulative shift amount accumulation data using deterioration curves corresponding to gradations, the display control section 100 according to an embodiment of the present disclosure such as described above is capable of obtaining a more accurate deterioration amount, and correcting luminance in accordance with the obtained deterioration amount.

Here, while a case has been shown in the above description where there is one set of corrected data generated from the cumulative efficiency accumulation data and the cumulative shift amount accumulation data for each grid, the present disclosure is not limited to such a case. For example, the display control section 100 according to an embodiment of the present disclosure may have one set of corrected data on the entire screen for each color. By having one set of corrected data on the entire screen for each color, the above described linear interpolation of corrected data and up-conversion process may not be necessary.

Figure 27:
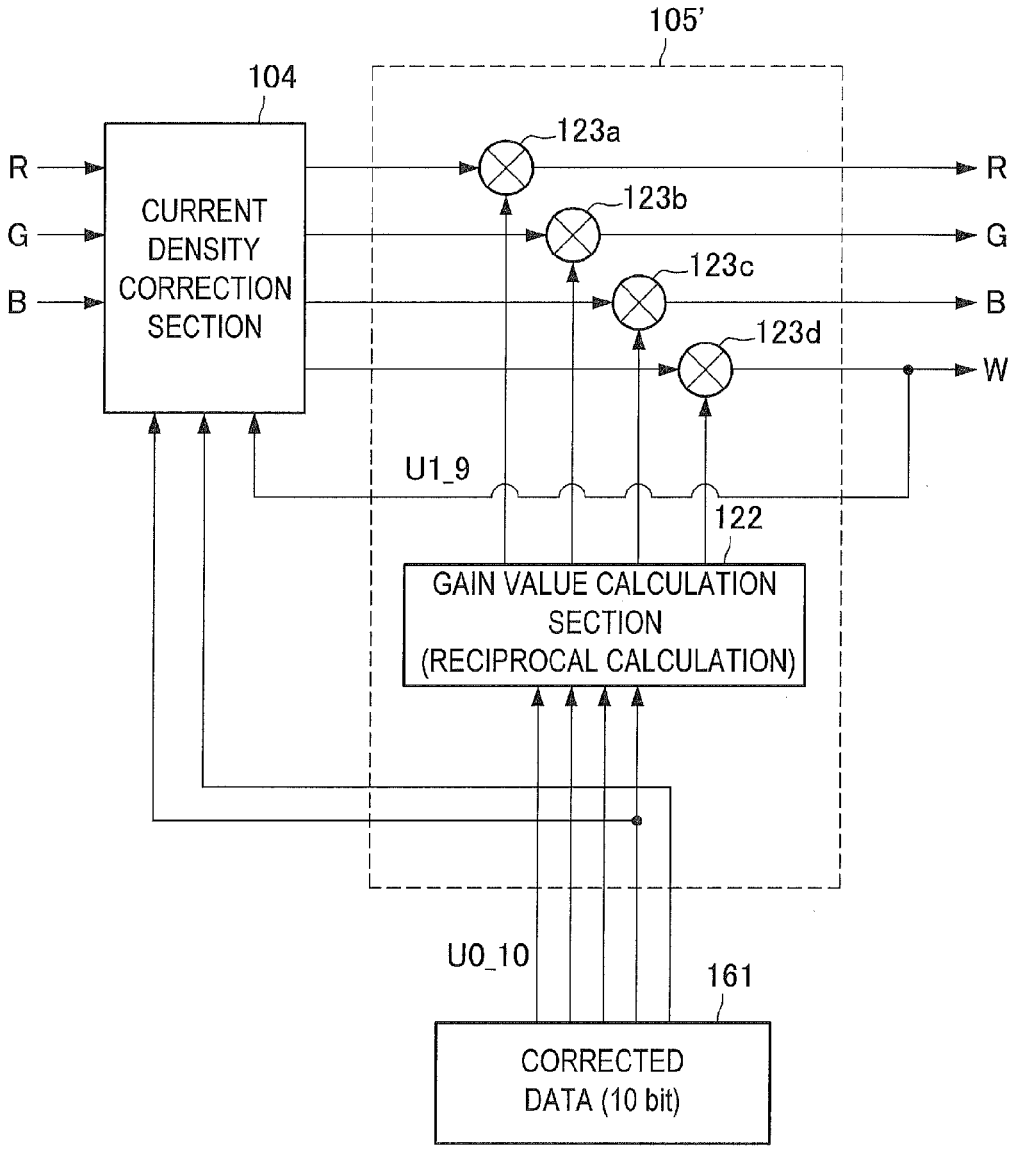
FIG. 27 is an explanatory diagram which shows a configuration example of an image persistence correction section 105'.

FIG. 27 is an explanatory diagram which shows a configuration example of an image persistence correction section 105', which is a modified example of the image persistence correction section 105 included in the display control section 100 according to an embodiment of the present disclosure, and is an example of the case where the corrected data stored in the corrected data 161 is one set of corrected data on the entire screen for each color. In the image persistence correction section 105' shown in FIG. 27, the corrected data grid interpolation section 121 from the image persistence correction section 105 shown in FIG. 5 is removed. This is because the corrected data stored in the corrected data 161 is one set of corrected data on the entire screen for each color.

Figure 28:
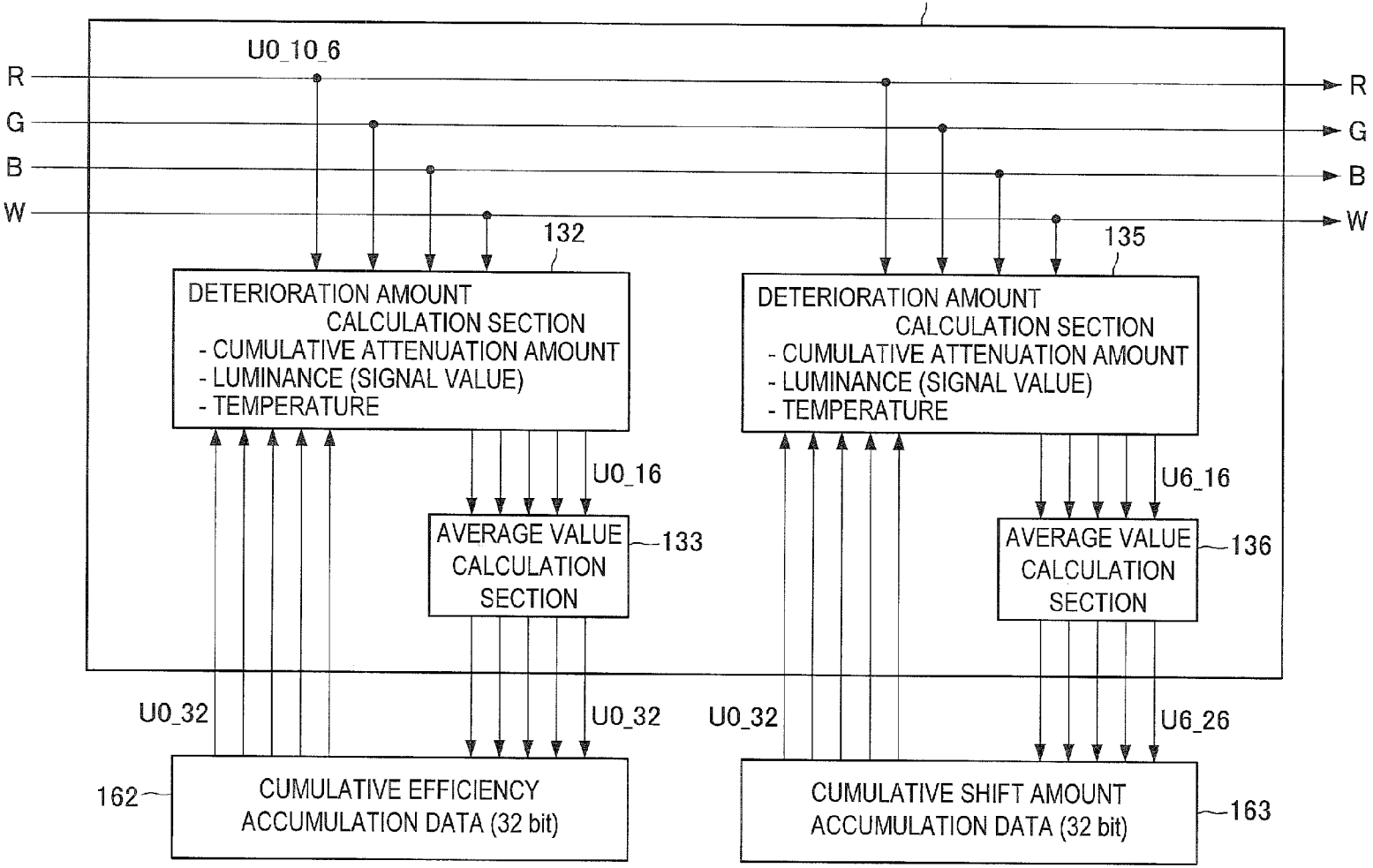
FIG. 28 is an explanatory diagram which shows a configuration example of an image persistence detection section 107'.

FIG. 28 is an explanatory diagram which shows a configuration example of an image persistence detection section 107', which is a modified example of the image persistence detection section 107 included in the display control section 100 according to an embodiment of the present disclosure, and is an example of the case where the corrected data stored in the corrected data 161 and 164 is one set of corrected data on the entire screen for each color. In the image persistence detection section 107' shown in FIG. 28, the corrected data conversion sections 131 and 134 from the image persistence detection section 107 shown in FIG. 6 are removed. This is because the corrected data stored in the corrected data 161 and 164 is one set of corrected data on the entire screen for each color.

Figure 29:
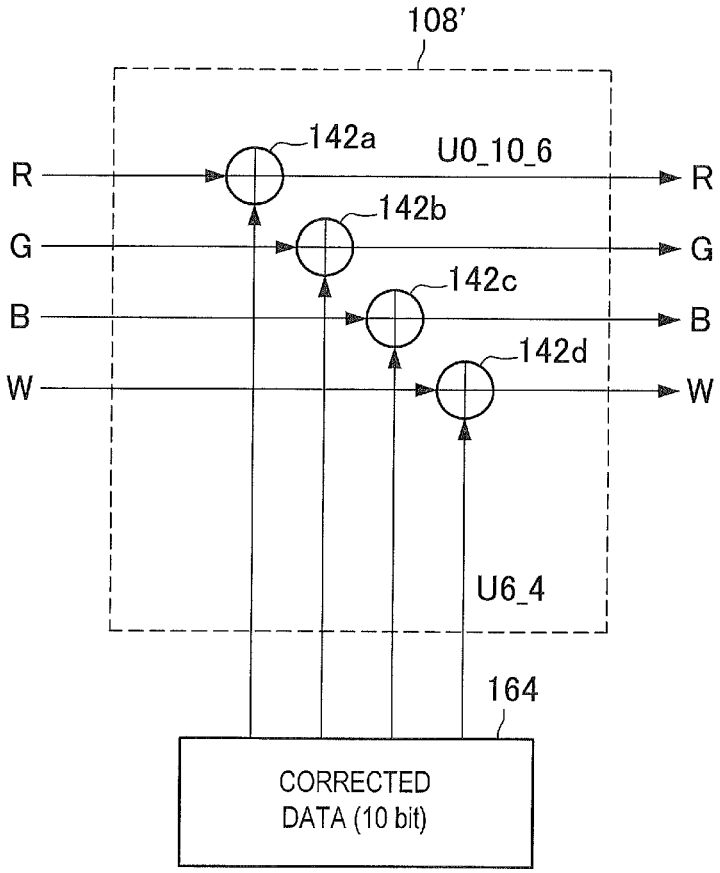
FIG. 29 is an explanatory diagram which shows a configuration example of an image persistence correction section 108'.

FIG. 29 is an explanatory diagram which shows a configuration example of an image persistence correction section 108', which is a modified example of the image persistence correction section 108 included in the display control section 100 according to an embodiment of the present disclosure, and is an example of the case where the corrected data stored in the corrected data 161 is one set of corrected data on the entire screen for each color. In the image persistence correction section 108' shown in FIG. 29, the corrected data grid interpolation section 141 from the image persistence correction section 108 shown in FIG. 7 is removed. This is because the corrected data stored in the corrected data 164 is one set of corrected data on the entire screen for each color.

In this way, in the case where one set of corrected data is set on the entire screen for each color, a configuration for performing a correction process of image persistence and an updating process of accumulation data can be omitted, such as shown in FIGS. 27 to 29.

Since the data amount will be small in the case where one set of corrected data is set on the entire screen for each color, an internal memory of a FPGA (Field Programmable Gate Array) or an internal memory of an ASIC (Application Specific Integrated Circuit) may be used instead of the DDR SDRAM 160.

2. CONCLUSION

The self-luminous display device 10 according to an embodiment of the present disclosure such as described above performs a calculation of cumulative efficiency accumulation data and cumulative shift amount accumulation data using deterioration curves corresponding to gradations. By performing a calculation of cumulative efficiency accumulation data and cumulative shift amount accumulation data using deterioration curves corresponding to gradations, the self-luminous display device 10 according to an embodiment of the present disclosure can obtain a more accurate deterioration amount, and can correct luminance in accordance with the obtained deterioration amount.

It may not be necessary for each step in the processes executed by each apparatus of the present disclosure to be performed in a time series process, in accordance with the order described in the sequence diagrams or flow charts. For example, each step in the processes executed by each apparatus may be performed in parallel, even if the processes are performed in an order different from the order described by the flow charts.

Further, a computer program for causing hardware, such as a CPU, ROM and RAM built-into each apparatus, to exhibit functions similar to the configurations of each of the above described apparatuses can be created. Further, a storage medium storing this computer program can also be provided. Further, a series of processes can be executed with the hardware, by configuring each of the functional blocks shown by the functional block figures with the hardware.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A self-luminous display device including:

a deterioration amount acquisition section configured to acquire a cumulative deterioration amount for each of a plurality of pixels arranged in a matrix shape on a screen, each of the pixels including a light emitting element which emits light by itself in accordance with a current amount;

a deterioration amount calculation section configured to calculate a deterioration amount when an image is displayed based on a supplied video signal in each of the pixels by using a deterioration characteristic determined in accordance with a luminance of the video signal; and a cumulative information update section configured to reflect the cumulative deterioration amount acquired by the deterioration amount acquisition section in the deterioration amount calculated by the deterioration amount calculation section, and to update the reflected cumulative deterioration amount as a new cumulative deterioration amount.

(2) The self-luminous display device according to (1), wherein the deterioration amount calculation section calculates the deterioration amount for the video signal after a gain is corrected based on corrected data generated based on the cumulative deterioration amount.

(3) The self-luminous display device according to (1) or (2), further including:

a video signal correction section configured to generate corrected data based on the cumulative deterioration amount, and to apply the corrected data to the supplied video signal.

(4) The self-luminous display device according to (3), wherein the video signal correction section generates a gain applied to the supplied video signal based on the cumulative deterioration amount.

(5) The self-luminous display device according to (3), wherein the video signal correction section generates an offset amount applied to the supplied video signal based on the cumulative deterioration amount.

(6) The self-luminous display device according to any one of (1) to (5), wherein the deterioration amount calculation section calculates a deterioration characteristic in a luminance of the supplied video signal by linear interpolation from a deterioration characteristic prepared in advance, and calculates a deterioration amount by using the calculated deterioration characteristic.

(7) The self-luminous display device according to any one of (1) to (6), wherein the cumulative deterioration amount is retained in a block unit in which a plurality of pixels are set as one block, and wherein the deterioration amount acquisition section acquires a cumulative deterioration amount for each pixel by interpolation between blocks.

(8) The self-luminous display device according to any one of (1) to (7), wherein the cumulative information update section reflects the cumulative deterioration amount acquired by the deterioration amount acquisition section in the deterioration amount calculated by the deterioration amount calculation section, and updates the reflected cumulative deterioration amount as a new cumulative deterioration amount within a prescribed period during the supply of the video signal.

(9) A control method of a self-luminous display device, the control method including:

acquiring a cumulative deterioration amount for each of a plurality of pixels arranged in a matrix shape on a screen, each of the pixels including a light emitting element which emits light by itself in accordance with a current amount;

calculating a deterioration amount when an image is displayed based on a supplied video signal by using a deterioration characteristic determined in accordance with a luminance of the video signal; and reflecting the deterioration amount calculated in the deterioration amount calculation step in the cumulative deterioration amount acquired in the deterioration amount acquisition step, and updating the reflected cumulative deterioration amount as a new cumulative deterioration amount.

(10) A computer program for causing a computer to execute:

acquiring a cumulative deterioration amount for each of a plurality of pixels arranged in a matrix shape on a screen, each of the pixels including a light emitting element which emits light by itself in accordance with a current amount;

calculating a deterioration amount when an image is displayed based on a supplied video signal by using a deterioration characteristic determined in accordance with a luminance of the video signal; and reflecting the deterioration amount calculated in the deterioration amount calculation step in the cumulative deterioration amount acquired in the deterioration amount acquisition step, and updating the reflected cumulative deterioration amount as a new cumulative deterioration amount.

What is claimed is:

1. A self-luminous display device, comprising:

a display panel having a plurality of pixels; and a display controller configured to:

acquire a cumulative deterioration amount for each of the plurality of pixels arranged in a matrix shape on the display panel, each of the pixels including a light emitting element which emits light by itself in accordance with a current amount;

calculate a deterioration amount in an event an image is displayed based on a supplied video signal in each of the pixels by using a deterioration characteristic determined in accordance with a luminance of the supplied video signal;

reflect the acquired cumulative deterioration amount in the calculated deterioration amount, and update the reflected cumulative deterioration amount as a new cumulative deterioration amount, wherein the new cumulative deterioration amount is stored in non-volatile memory and a corrected data is generated from the stored cumulative deterioration amount;

control an overall uniform luminance for the supplied video signal based on the corrected data, wherein the overall uniform luminance is controlled by detecting a minimum value of luminous efficiency of one or more pixels from the corrected data and uniformly multiplying the detected minimum value of the luminous efficiency with signals from the plurality of pixels in the display panel; and generate a gain based on the corrected data, and apply the gain to the supplied video signal having the controlled overall uniform luminance, wherein the corrected data is stored in non-volatile memory, and wherein the corrected data is read out from the non-volatile memory and is used in calculating the deterioration amount.

2. The self-luminous display device according to claim 1, wherein the display controller is configured to calculate the deterioration amount for the supplied video signal after the gain is corrected based on the corrected data.

3. The self-luminous display device according to claim 1, wherein the display controller is configured to generate an offset amount applied to the supplied video signal based on the cumulative deterioration amount.

4. The self-luminous display device according to claim 1, wherein the display controller is configured to calculate the deterioration characteristic in the luminance of the supplied video signal by linear interpolation from a deterioration characteristic prepared in advance, and calculate the deterioration amount by using the calculated deterioration characteristic.

5. The self-luminous display device according to claim 1, wherein the cumulative deterioration amount is retained in a block unit in which a plurality of pixels are set as one block, and wherein the display controller is configured to acquire the cumulative deterioration amount for each pixel by interpolation between blocks.

6. The self-luminous display device according to claim 1, wherein the display controller is configured to reflect the acquired cumulative deterioration amount in the calculated deterioration amount, and update the reflected cumulative deterioration amount as the new cumulative deterioration amount within a prescribed period during the supply of the supplied video signal.

7. The self-luminous display device according to claim 1, wherein, for each of the pixels, the calculated deterioration amount is subtracted from cumulative efficiency accumulation data developed for all of the pixels, by referring to a look-up table.

8. The self-luminous display device according to claim 7, wherein the look-up table stores inclinations of deterioration curves for shift amounts and gradations.

9. The self-luminous display device according to claim 8, wherein the display controller is configured to obtain an inclination of a gradation by performing linear interpolation of the inclinations stored in the look-up table.

10. The self-luminous display device according to claim 1, wherein the display controller is configured to correct image persistence for the plurality of pixels by generating corrected data for the plurality of pixels by linear interpolation in an event the corrected data is present for one pixel in a correction width of a prescribed grid shape.

11. A method for controlling a self-luminous display device, the control method comprising:

in a display controller:

acquiring a cumulative deterioration amount for each of a plurality of pixels arranged in a matrix shape on a screen of a display panel, each of the pixels including a light emitting element which emits light by itself in accordance with a current amount;

calculating a deterioration amount in an event an image is displayed based on a supplied video signal by using a deterioration characteristic determined in accordance with a luminance of the supplied video signal;

reflecting the deterioration amount calculated in the deterioration amount calculation step in the cumulative deterioration amount acquired in the deterioration amount acquisition step, and updating the reflected cumulative deterioration amount as a new cumulative deterioration amount, wherein the new cumulative deterioration amount is stored in non-volatile memory and a corrected data is generated from the stored cumulative deterioration amount;

controlling an overall uniform luminance for the supplied video signal based on the corrected data, wherein the overall uniform luminance is controlled by detecting a minimum value of luminous efficiency of one or more pixels from the corrected data and uniformly multiplying the detected minimum value of the luminous efficiency with signals from the plurality of pixels in the display panel; and generating a gain based on the corrected data, and applying the gain to the supplied video signal having the controlled overall uniform luminance, wherein the corrected data is read out from the non-volatile memory and is used in calculating the deterioration amount.

12. A non-transitory computer-readable storage medium having stored thereon a set of instructions for controlling a self-luminous display device, the set of instructions causing a computer to perform the operations, comprising:

in a display controller:

acquiring a cumulative deterioration amount for each of a plurality of pixels arranged in a matrix shape on a screen of a display panel, each of the pixels including a light emitting element which emits light by itself in accordance with a current amount;

calculating a deterioration amount in an event an image is displayed based on a supplied video signal by using a deterioration characteristic determined in accordance with a luminance of the supplied video signal;

reflecting the deterioration amount calculated in the deterioration amount calculation step in the cumulative deterioration amount acquired in the deterioration amount acquisition step, and updating the reflected cumulative deterioration amount as a new cumulative deterioration amount, wherein the new cumulative deterioration amount is stored in non-volatile memory and a corrected data is generated from the stored cumulative deterioration amount;

controlling an overall uniform luminance for the supplied video signal based on the corrected data, wherein the overall uniform luminance is controlled by detecting a minimum value of luminous efficiency of one or more pixels from the corrected data and uniformly multiplying the detected minimum value of the luminous efficiency with signals from the plurality of pixels in the display panel; and generating a gain based on the corrected data, and applying the gain to the supplied video signal having the controlled overall uniform luminance, wherein the corrected data is read out from the non-volatile memory and is used in calculating the deterioration amount.

* * * * *